US008881567B2

(12) United States Patent
Chong et al.

(10) Patent No.: US 8,881,567 B2
(45) Date of Patent: Nov. 11, 2014

(54) RESET FIXTURE FOR REKEYABLE LOCK ASSEMBLY

(75) Inventors: Gerald B. Chong, Rowland Heights, CA (US); Steven Armstrong, San Juan Capistrano, CA (US)

(73) Assignee: Kwikset Corporation, Foothill Ranch, CA (US)

( * ) Notice: Subject to any disclaimer, the term of this patent is extended or adjusted under 35 U.S.C. 154(b) by 0 days.

(21) Appl. No.: 11/255,616

(22) Filed: Oct. 21, 2005

(65) Prior Publication Data

US 2007/0089468 A1 Apr. 26, 2007

(51) Int. Cl.
*E05B 25/00* (2006.01)
*E05B 29/00* (2006.01)

(52) U.S. Cl.
CPC ..... *E05B 29/004* (2013.01)
USPC ..... 70/383; 70/375; 70/493; 70/386; 29/804

(58) Field of Classification Search
CPC .... B25B 21/002; E05B 29/004; E05B 35/125
USPC ..... 70/336–339, 367–369, 376, 377, 70/382–385, 491–493, 495; 29/804, 29/281.1, 251
See application file for complete search history.

(56) References Cited

U.S. PATENT DOCUMENTS 1,565,556 A 12/1925 Fremon
1,610,224 A 12/1926 Dalboni et al.
1,965,889 A 7/1934 Gerald
2,139,842 A 12/1938 Miller
2,194,469 A 3/1940 Fremon
2,232,017 A 2/1941 Wilder
2,370,862 A 3/1945 Johnstone
2,391,832 A 12/1945 Johnstone
2,895,323 A 7/1959 Ernest
2,977,786 A 4/1961 Marron
3,111,748 A * 11/1963 Doll et al. ..... 29/712
3,149,486 A 9/1964 Russell
3,183,692 A 5/1965 Check
3,190,093 A 6/1965 Schlage
3,320,781 A 5/1967 Hill
3,417,452 A * 12/1968 Roland ..... 29/804
3,589,153 A 6/1971 Hill
3,667,262 A 6/1972 Hill
3,726,116 A 4/1973 DiMotta
3,728,880 A 4/1973 Falk
3,735,612 A 5/1973 Popovici
3,754,422 A 8/1973 Stackhouse
3,910,083 A 10/1975 Burlingame
3,990,282 A 11/1976 Sorum
3,999,413 A 12/1976 Raymond et al.

(Continued)

FOREIGN PATENT DOCUMENTS

EP 0157967 10/1985
EP 0210037 1/1987

(Continued)

*Primary Examiner* — Suzanne Barrett
(74) *Attorney, Agent, or Firm* — Barnes & Thornburg LLP

(57) ABSTRACT

A reset fixture for a rekeyable lock cylinder includes a housing with a central recess for receiving a cylinder body. A first opening communicating with the central recess is defined in the housing for receiving a reset tool. A second opening communicating with the central recess is defined in the housing for receiving a bracing bar.

7 Claims, 43 Drawing Sheets

(56) References Cited

U.S. PATENT DOCUMENTS

| | | | | | |
|---|---|---|---|---|---|
| 4,015,458 | A | | 4/1977 | Mercurio | |
| 4,069,694 | A | | 1/1978 | Raymond et al. | |
| 4,094,175 | A | | 6/1978 | Pechner | |
| 4,142,391 | A | | 3/1979 | Paig | |
| 4,320,639 | A | | 3/1982 | Kleefeldt et al. | |
| 4,372,139 | A | | 2/1983 | Laake | |
| 4,376,382 | A | | 3/1983 | Raymond et al. | |
| 4,377,940 | A | | 3/1983 | Hucknall | |
| 4,393,673 | A | | 7/1983 | Widén | |
| 4,404,824 | A | | 9/1983 | Hennessy | |
| 4,412,437 | A | | 11/1983 | Smith | |
| 4,440,009 | A | | 4/1984 | Smith | |
| 4,680,860 | A | * | 7/1987 | Detloff | 29/804 |
| 4,689,978 | A | | 9/1987 | Drummond | |
| 4,712,399 | A | | 12/1987 | Mattossovich | |
| 4,712,401 | A | | 12/1987 | Monahan | |
| 4,712,402 | A | | 12/1987 | Monahan | |
| 4,729,231 | A | | 3/1988 | Wu | |
| 4,732,023 | A | | 3/1988 | Shen | |
| 4,741,188 | A | | 5/1988 | Smith | |
| 4,747,281 | A | | 5/1988 | Monahan | |
| 4,765,163 | A | | 8/1988 | Trull et al. | |
| 4,794,772 | A | | 1/1989 | Falk et al. | |
| 4,836,002 | A | | 6/1989 | Monahan | |
| 4,850,210 | A | * | 7/1989 | Adler et al. | 70/383 |
| 4,899,563 | A | | 2/1990 | Martin | |
| 4,909,053 | A | | 3/1990 | Zipf, III et al. | |
| 4,912,953 | A | | 4/1990 | Wobig | |
| 4,920,774 | A | | 5/1990 | Martin | |
| 4,942,749 | A | | 7/1990 | Rabinow | |
| 4,966,021 | A | | 10/1990 | Boag | |
| 4,996,856 | A | | 3/1991 | Lin et al. | |
| 5,010,753 | A | | 4/1991 | Boris, Jr. | |
| 5,024,071 | A | | 6/1991 | Shafirkin | |
| 5,038,589 | A | | 8/1991 | Martin | |
| 5,044,180 | A | | 9/1991 | Lebrecht | |
| 5,076,081 | A | | 12/1991 | Boris, Jr. | |
| 5,121,619 | A | | 6/1992 | Martin | |
| 5,174,136 | A | | 12/1992 | Thwing | |
| 5,209,088 | A | | 5/1993 | Vaks | |
| 5,211,044 | A | | 5/1993 | Kim | |
| 5,233,850 | A | | 8/1993 | Schroeder | |
| 5,325,690 | A | * | 7/1994 | Adler et al. | 70/383 |
| 5,428,978 | A | | 7/1995 | Tsukano | |
| 5,431,034 | A | | 7/1995 | Fann et al. | |
| 5,540,071 | A | | 7/1996 | Reikher | |
| 5,640,865 | A | | 6/1997 | Widén | |
| 5,704,234 | A | | 1/1998 | Resch | |
| 5,718,136 | A | | 2/1998 | Aldieri et al. | |
| 5,735,153 | A | * | 4/1998 | Hanneman et al. | 70/493 |
| 5,752,400 | A | | 5/1998 | Kim | |
| 5,765,417 | A | | 6/1998 | Bolton | |
| 5,791,181 | A | | 8/1998 | Sperber et al. | |
| 5,839,309 | A | * | 11/1998 | Fantl et al. | 70/493 |
| 5,884,512 | A | | 3/1999 | Wayne | |
| 5,921,122 | A | * | 7/1999 | Lin | 70/368 |
| 5,921,123 | A | | 7/1999 | Schwarzkopf et al. | |
| 5,970,760 | A | | 10/1999 | Shen | |
| 5,979,200 | A | | 11/1999 | Cliff | |
| 6,021,655 | A | * | 2/2000 | Labbe et al. | 70/493 |
| 6,029,484 | A | | 2/2000 | Jetton | |
| 6,047,577 | A | | 4/2000 | Klimas | |
| 6,076,386 | A | | 6/2000 | Etchells et al. | |
| 6,079,240 | A | | 6/2000 | Shvarts | |
| 6,119,495 | A | | 9/2000 | Loreti | |
| 6,134,928 | A | | 10/2000 | Kang | |
| 6,142,717 | A | * | 11/2000 | Staiger | 408/115 R |
| 6,295,725 | B1 | * | 10/2001 | King et al. | 29/804 |
| 6,295,850 | B1 | | 10/2001 | Anderson | |
| 6,425,274 | B1 | | 7/2002 | Laitala et al. | |
| 6,516,643 | B1 | | 2/2003 | Olshausen | |
| 6,523,378 | B2 | | 2/2003 | Kuo | |
| 6,532,782 | B2 | | 3/2003 | Chiu | |
| 6,564,601 | B2 | | 5/2003 | Hyatt Jr. | |
| 6,755,063 | B2 | | 6/2004 | Takadama | |
| 6,776,017 | B2 | | 8/2004 | Herdman | |
| 6,871,520 | B2 | * | 3/2005 | Armstrong et al. | 70/492 |
| 7,047,778 | B2 | * | 5/2006 | Dimig et al. | 70/495 |
| 7,565,825 | B2 | * | 7/2009 | Wheatland et al. | 70/383 |
| 7,685,853 | B2 | * | 3/2010 | Burkart | 70/375 |
| 7,905,124 | B2 | * | 3/2011 | Komemi | 70/358 |
| 2003/0037582 | A1 | | 2/2003 | Edwards, Jr. et al. | |
| 2003/0089149 | A1 | | 5/2003 | Suzuki et al. | |
| 2003/0154753 | A1 | | 8/2003 | Dimig et al. | |
| 2003/0217576 | A1 | * | 11/2003 | Koluch | 70/493 |
| 2004/0060331 | A1 | * | 4/2004 | Armstrong et al. | 70/383 |
| 2004/0060333 | A1 | * | 4/2004 | Armstrong et al. | 70/493 |
| 2005/0172687 | A1 | * | 8/2005 | Segien et al. | 70/493 |

FOREIGN PATENT DOCUMENTS

| | | |
|---|---|---|
| EP | 0872615 | 10/1998 |
| WO | WO9314290 | 7/1993 |
| WO | WO9736072 | 10/1997 |

* cited by examiner

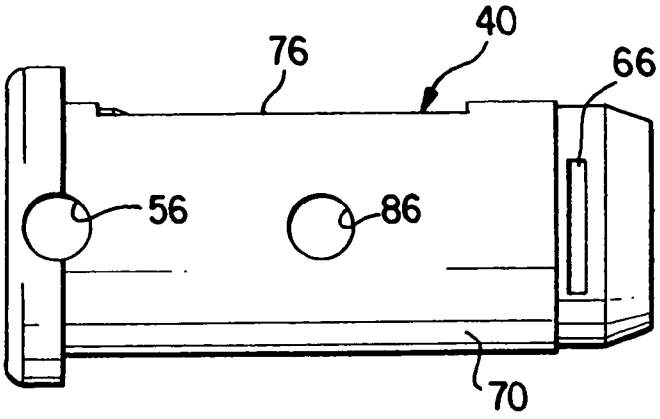
FIG. 16D
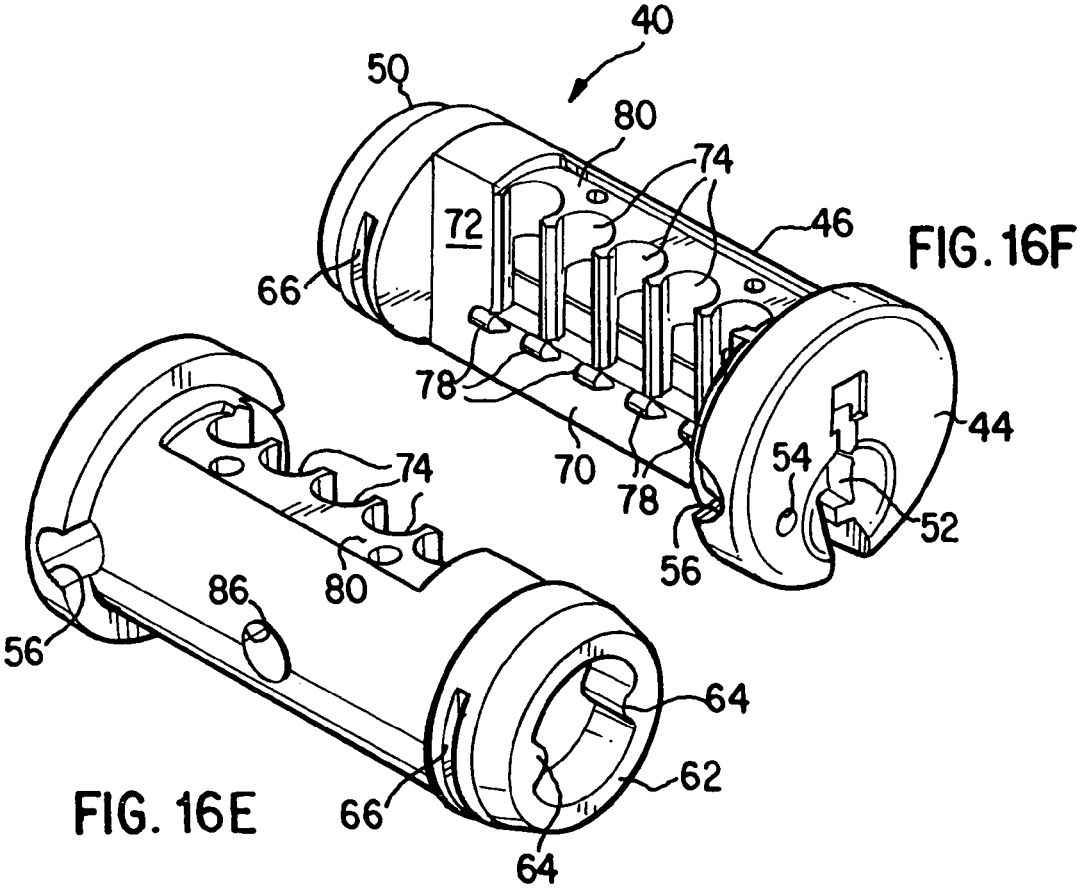
FIG. 16F
FIG. 16E

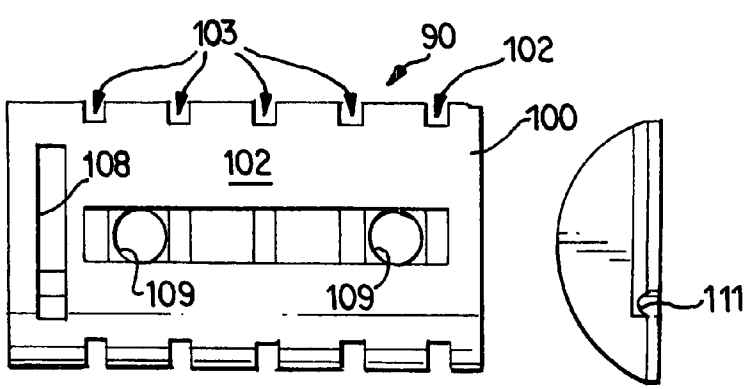
FIG.17A
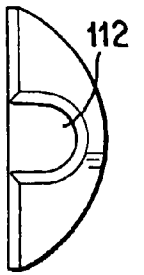
FIG.17B
FIG.17C
FIG.17D
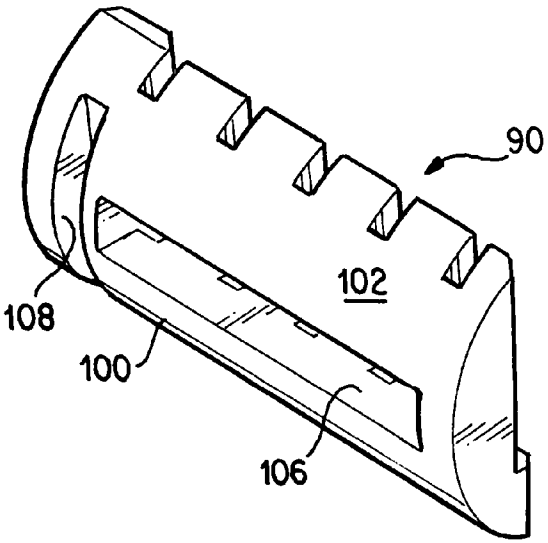
FIG.17E
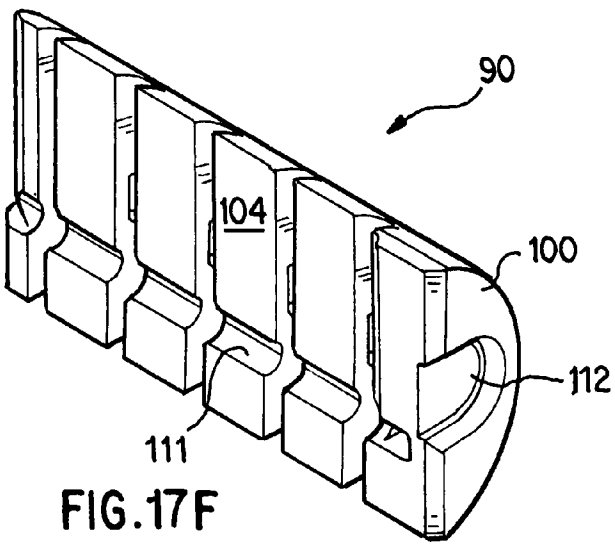
FIG.17F

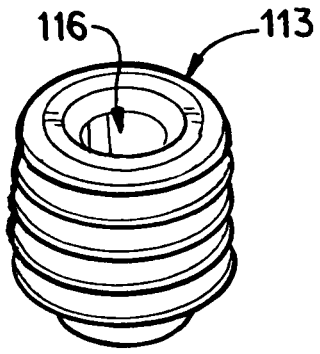
FIG. 20A
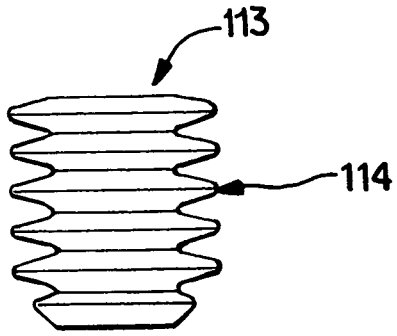
FIG. 20B
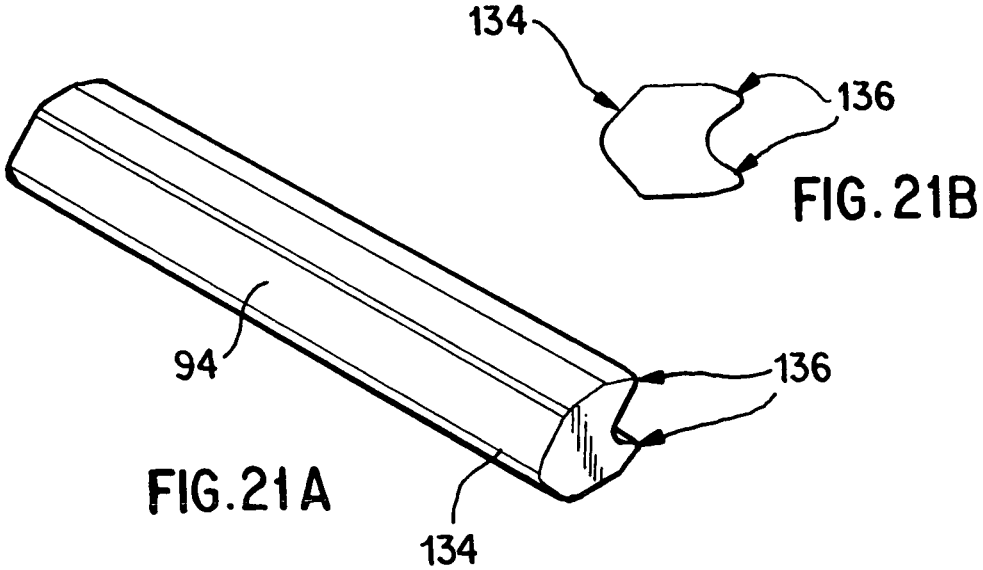
FIG. 21B
FIG. 21A

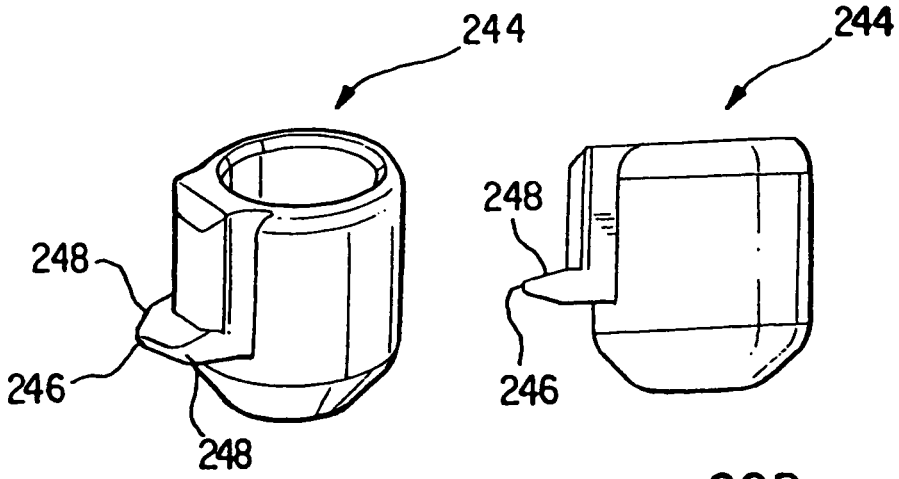
FIG. 28A
FIG. 28B
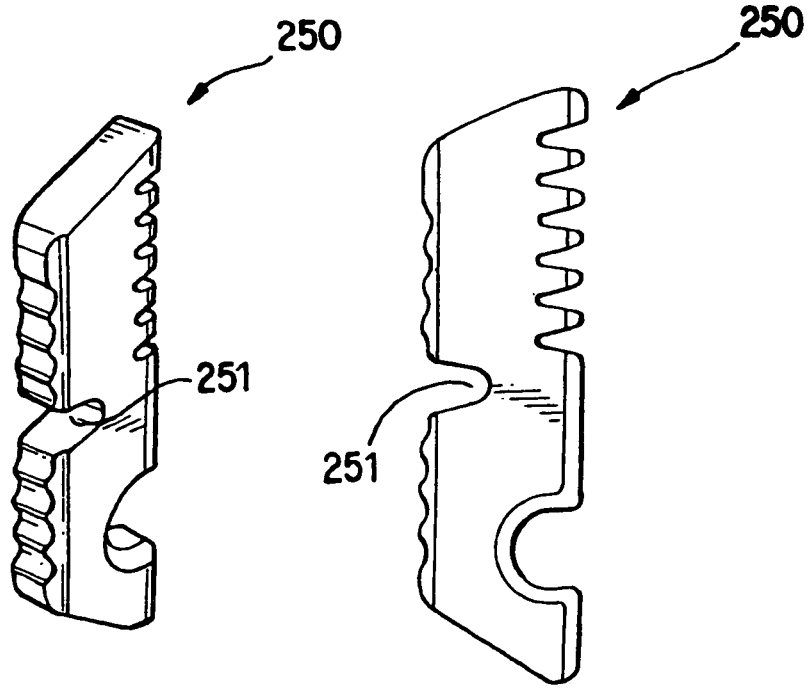
FIG. 29A
FIG. 29B

RESET FIXTURE FOR REKEYABLE LOCK ASSEMBLY

BACKGROUND

When rekeying a lock assembly having a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

Various locks have been designed in an effort to overcome these problems. One design is disclosed herein and allows a user to rekey a lock cylinder without removing the lock plug from the cylinder body or even removing the lock cylinder from the knob, lever or deadbolt in which it's installed. To rekey the lock cylinder described herein, a user inserts a first valid key in the keyway (home position) and rotates it about 90° to a rekeying position. The user then inserts a reset tool into the lock face, as illustrated in FIG. 54, to reconfigure the lock cylinder to a learn mode. While the lock cylinder is in the learn mode, the user removes the first valid key, replaces it with a second valid key and rotates the second valid key back to the home position. The process of rotating the key back the home position releases the lock cylinder from the learn mode and resets the lock cylinder to conform to the bitting of the second valid key. At this point, the first valid key no longer operates the lock cylinder.

Unfortunately, such a lock cylinder can be rendered inoperable if the user does not fully insert the second valid key in the keyway when the lock is in the learn mode. The reason for this is based in the way a lock works. As is known in the art, keys have certain key cuts at different positions along the key blade (bitting). The depth of a key cut is typically numbered from 0 to 6, with 0 being flush with the top of the key blade and 6 being the deepest cut. In the lock cylinder disclosed herein, the key bitting determines the positioning of pins. When a valid key is inserted, the pins are positioned to release a locking bar, allowing the lock plug to rotate within the cylinder body, thereby retracting a latch or deadbolt. If the second valid key is not fully inserted during the rekeying process, the pins will not be set to conform to the bitting of the second valid key, resulting in a blown cylinder.

To aide in recovering a lock cylinder from a blown condition, a manual reset tool was developed, as described herein and illustrated in FIGS. 31-34. With the lock cylinder removed from the knob or deadbolt, the reset tool is inserted into the bottom of the cylinder body to manually position the pins to release the locking bar. Simultaneously, a bracing tool is inserted into an aperture in the side of the cylinder body to displace the locking bar (FIG. 40) and allow the plug body to rotate in the cylinder body to the rekeying position. A learn tool is then inserted into an aperture in the face of the lock cylinder to configure the lock cylinder to the learn mode. Once in the learn mode, the reset tool and bracing tool are removed and a valid key is inserted in the keyway and returned to the home position, thereby resetting the lock cylinder to the valid key.

One difficulty with the manual reset tool is the need for serious manual dexterity in managing the lock cylinder, the reset tool and the bracing tool, while inserting a learn tool in the face of the lock cylinder and inserting a key in the keyway and rotating the key to the rekeying position.

SUMMARY

An exemplary embodiment provides a reset fixture for rekeying a rekeyable lock cylinder. The fixture includes a housing having a recess for receiving the lock cylinder, a first opening and a second opening, the first and second opening communicating with the recess. A reset tool is disposed for movement in the first opening to engage the racks, and a bracing bar is disposed for movement in the second opening to engage the locking bar.

The rekeyable lock cylinder includes a plurality of racks and a body defining a plurality of apertures aligned with the plurality of racks. The reset tool includes a plurality of prongs operatively aligned with the plurality of apertures and the plurality of racks. The reset fixture further comprises a retaining pin disposed in the housing to engage the bracing bar. The bracing bar includes a distal end and a retaining catch formed on the distal end for releasably engaging the retaining pin.

The recess of the reset fixture includes a first axis, the reset tool includes a second axis, and the bracing bar includes a third axis, with the second and third axes being perpendicular to the first axis.

BRIEF DESCRIPTION OF THE DRAWINGS

The exemplary embodiment and its wide variety of alternative embodiments will be readily understood via the following detailed description of certain exemplary embodiments, with reference to the accompanying drawings in which:

FIGS. 16*a*-16*f* are various views of the cylinder plug body.

FIGS. 17*a*-17*f* are various view of a carrier.

FIGS. 20*a*-20*b* are views of a pin.

FIGS. 21*a*-21*b* are views of a locking bar.

FIGS. 28*a*-28*b* are views of an alternative embodiment of a pin.

FIGS. 29*a*-29*b* are views of an alternative embodiment of a rack.

DETAILED DESCRIPTION

Figure 1:
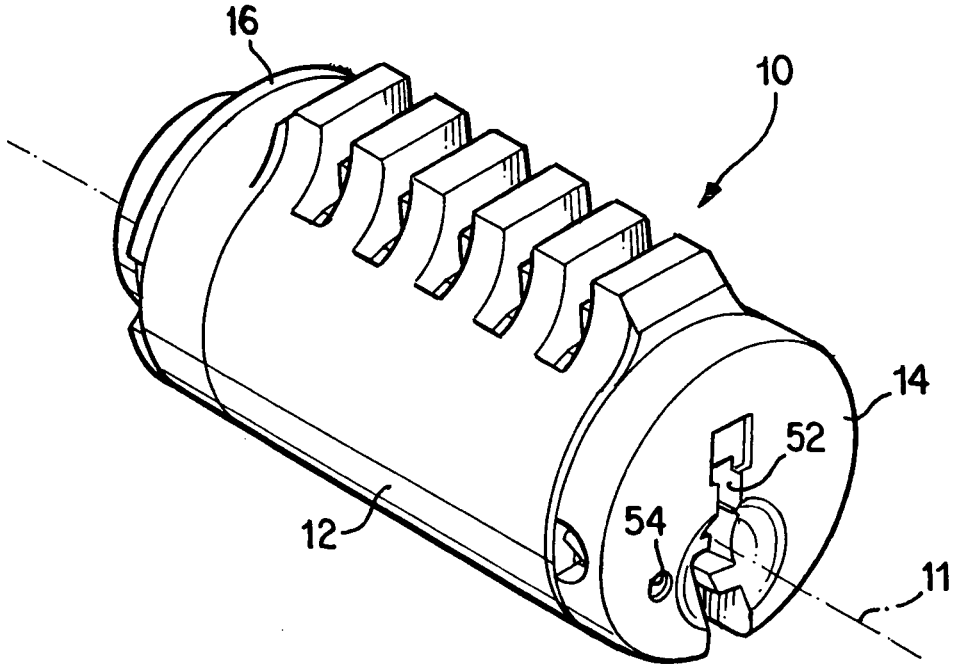
FIG. 1 illustrates a rekeyable lock cylinder.

An exemplary embodiment of a rekeyable lock cylinder 10 is illustrated in FIG. 1-22. The lock cylinder 10 includes a longitudinal axis 11, a lock cylinder body 12, a plug assembly 14 and a retainer 16. In FIG. 1, the plug assembly 14 is in the home position relative to the cylinder body 12.

The lock cylinder body 12, as seen in FIGS. 15*a*-15*e*, includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32. The generally V-shaped locking bar-engaging groove 29 extends longitudinally along a portion of the cylinder body 12 from the front end 22. The first detent recess 30 is disposed at the back end 24 and extends to a first depth. The second detent recess 32 is disposed adjacent the first detent recess 30 and extends to a lesser depth. A detent bore 34 extends radially through the cylinder wall 26 for receiving a detent ball 36 (FIG. 2).

Figure 2:
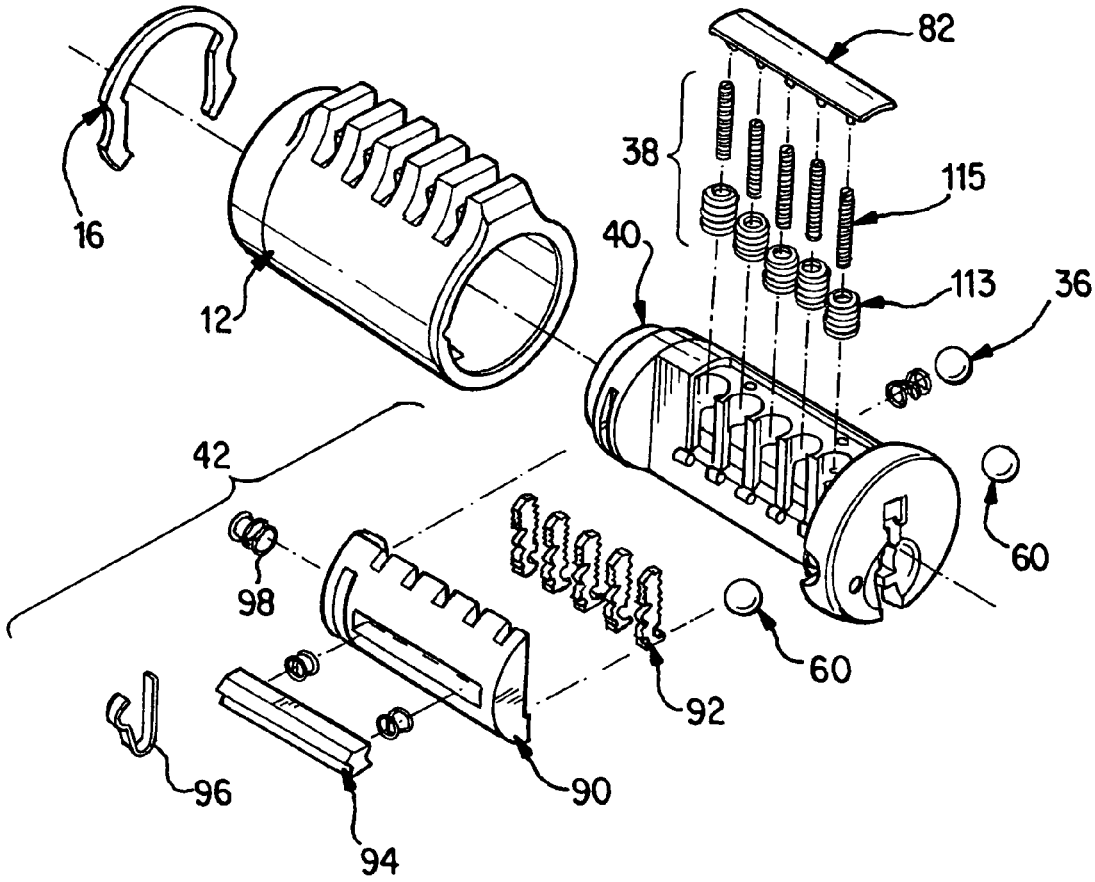
FIG. 2 is an exploded view of the lock cylinder of FIG. 1.

The plug assembly 14 includes a plug body 40, a carrier sub-assembly 42 and a plurality of spring-loaded pins 38 (FIGS. 2 and 20*a*-20*b*). The plug body 40, illustrated in FIGS. 16*a*-16*f*, includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60 (FIG. 2). The drive portion 50 includes an annular wall 62 with a pair of opposed projections 64 extending radially inwardly to drive a spindle or torque blade (neither shown). The drive portion 50 further includes a pair of slots 66 formed in its perimeter for receiving the retainer 16 to retain the plug body 40 in the cylinder body 12.

The intermediate portion 46 includes a main portion 70 formed as a cylinder section and having a first longitudinal planar surface 72 and a plurality of channels 74 for receiving the spring-loaded pins 38. The channels 74 extend transversely to the longitudinal axis of the plug body 40 and parallel to the planar surface 72. A second planar surface 76 extends perpendicular to the first planar surface 72 and defines a recess 80 for receiving a retaining cap 82 (FIGS. 2 and 22*a*-22*d*). The channels 74 extend from the second planar surface 76 partially through the plug body 40, with the sidewalls of the channels open to the first planar surface 72. The first planar surface 72 further includes a plurality of bullet-shaped, rack-engaging features 78. A bore 86 for receiving a spring-loaded detent ball 36 (FIG. 2) extends radially inwardly from opposite the first planar surface 72.

The carrier sub-assembly 42 (FIGS. 2, 6 and 10) includes a carrier 90 (FIGS. 17*a*-17*e*), a plurality of racks 92 (FIGS. 18*a*-18*b*), a spring catch 96 (FIGS. 19*a*-19*b*), a spring-loaded locking bar 94 (FIGS. 21*a*-21*b*), and a return spring 98 (FIG. 2). The carrier 90 includes a body 100 in the form of a cylinder section that is complementary to the main portion 70 of the plug body 40, such that the carrier 90 and the main portion 70 combine to form a cylinder that fits inside the lock cylinder body 12. The carrier 90 includes a curved surface 102 and a flat surface 104. The curved surface 102 includes a locking bar recess 106 and a spring catch recess 108. The locking bar recess 106 further includes a pair of return spring-receiving bores 109 (FIG. 17*c*) for receiving the locking bar return springs. The flat surface 104 includes a plurality of parallel rack-receiving slots 102 extending perpendicular to the longitudinal axis of the carrier. A semi-circular groove 111 extends along the flat surface 104 parallel to the longitudinal axis of the carrier 90. The back end of the carrier 90 includes a recess 112 for receiving the return spring 98.

Figure 7:
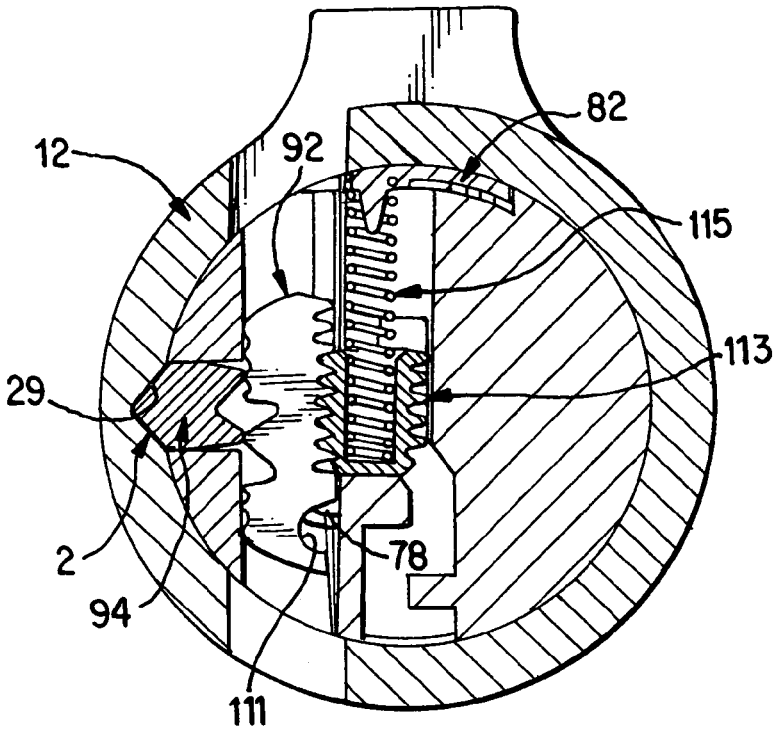
FIG. 7 is a section view through the plug assembly of FIG. 3 and a cylinder body, the section being taken transversely at one of the pins and illustrating the positioning of the pin, a rack, and the locking bar relative to each other and the cylinder body in a locked configuration.
Figure 12:
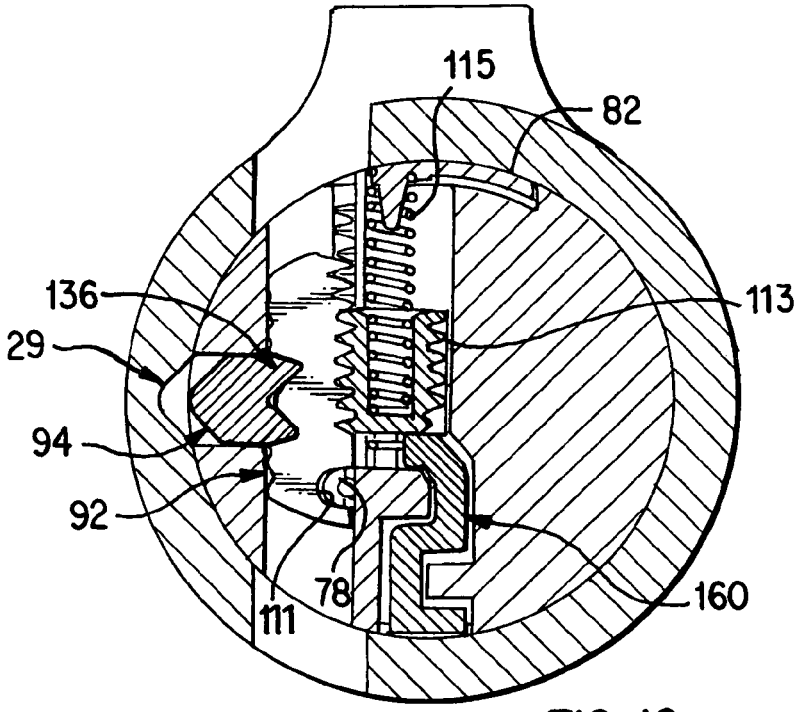
FIG. 12 is a section view through the plug assembly of FIG. 8 and a cylinder body, the section being taken transversely at one of the pins and illustrating the positioning of the pin, the rack, and the locking bar relative to each other and the cylinder body in an unlocked configuration.

Each spring-loaded pin 38 includes a pin 113 and a biasing spring 115. The pins 113, illustrated in FIGS. 20*a*-20*b*, are generally cylindrical with annular gear teeth 114 and a central longitudinal bore 116 for receiving biasing springs 115 (FIG. 2). The racks 92, illustrated in FIGS. 18*a*-18*b*, include a pin-engaging surface 118 having a plurality of gear teeth 122 configured to engage the annular gear teeth 114 on the pins 113, as illustrated in FIGS. 7 and 12, and a semi-circular recess 124 for engaging the bullet-shaped, rack-engaging features 78 on the planar surface 72, as illustrated in FIG. 12. The racks 92 further include a second surface 126 that includes a plurality of anti-pick grooves 128 and a pair of locking bar-engaging grooves 132.

The spring-loaded locking bar 94, illustrated in FIGS. 21*a*-22*b*, is sized and configured to fit in the locking bar recess 106 in the carrier 90 and includes a triangular edge 134 configured to fit in the V-shaped locking bar-engaging groove 29. Opposite the triangular edge 134, the locking bar 94 includes a pair of longitudinally extending gear teeth 136 configured to engage the locking bar-engaging grooves 132 formed in the racks 92, as illustrated in FIG. 12.

The spring-retaining cap 82, illustrated in FIGS. 22*a*-22*d*, includes a curvilinear portion 140 having an upper surface 142 and a lower surface 144. The thickness of the curvilinear portion 140 is set to allow the curvilinear portion 140 to fit in the recess 80 with the upper surface 142 flush with the intermediate portion 46 of the plug body 40, as illustrated in FIGS. 7 and 12. A plurality of spring alignment tips 146 extend from the lower surface 144 to engage the springs 148. In addition, a pair of cap retaining tips 152 extend from the lower surface 144 to engage alignment openings 154 formed in the plug body 40 (FIGS. 16*e*-16*f*).

Figure 3:
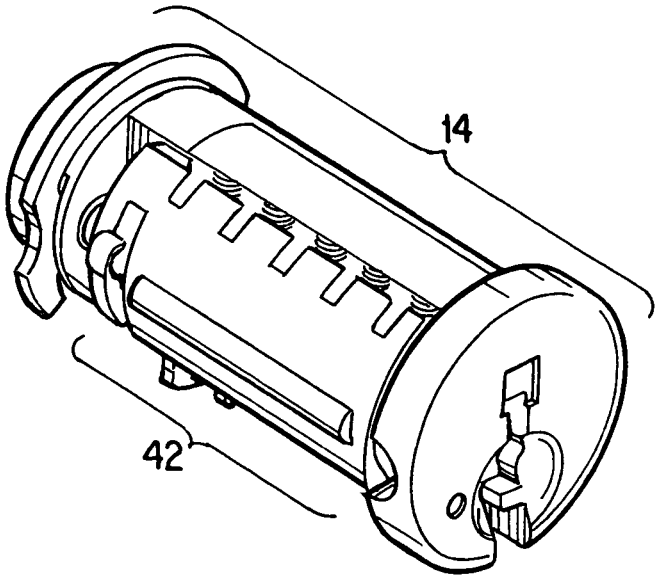
FIG. 3 is a perspective view of a plug assembly illustrating a carrier sub-assembly with a locking bar disposed in a locking position to lock the plug assembly in a lock cylinder body.

To assemble the lock cylinder 10, the pins 113 and spring 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 102 and the spring-loaded locking bar 94 into the locking bar recess 106, with the gear teeth 136 engaging the locking bar-engaging grooves 132 formed in the racks 92. The spring catch 96 is disposed in the spring catch recess 108 of the carrier 90. A valid key 160 is inserted into the keyway 52, the return spring 98 is compressed into the return spring recess 112, and the carrier sub-assembly is placed adjacent the plug body 40, as illustrated in FIG. 3. The plug assembly 14 is placed in the lock cylinder body 12 and the retainer 16 is disposed in the slots 66 formed in the plug body 40 to retain the plug assembly 14 in the cylinder body 12. The lock cylinder 10 is now keyed to the valid key 160.

Figure 4:
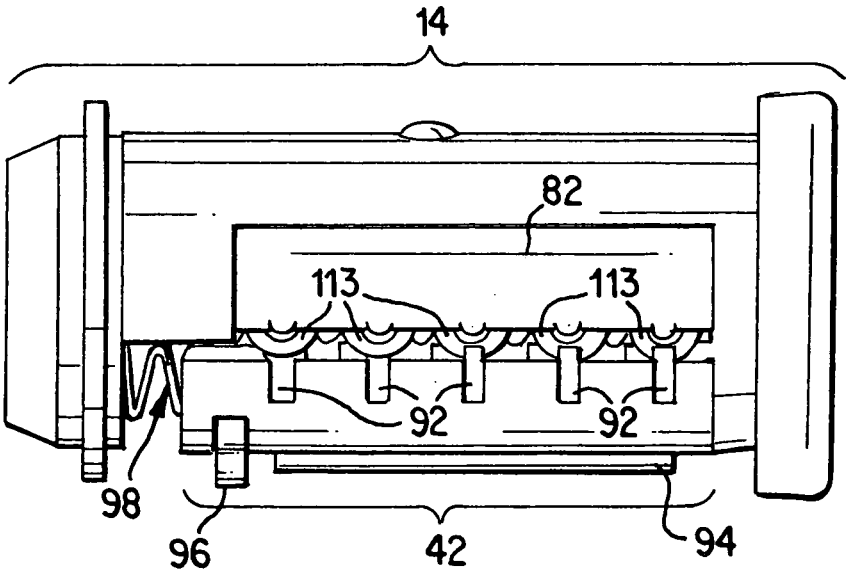
FIG. 4 is a top plan view of the plug assembly of FIG. 3.
Figure 5:
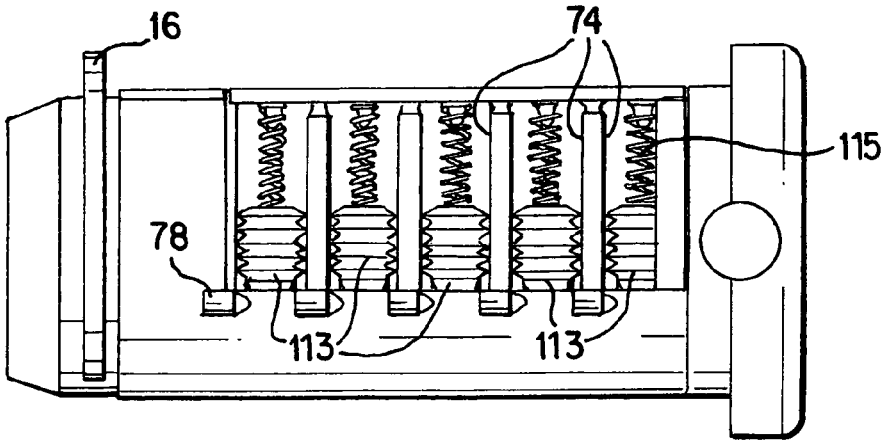
FIG. 5 is a partially broken away side view of the plug assembly of FIG. 3.
Figure 6:
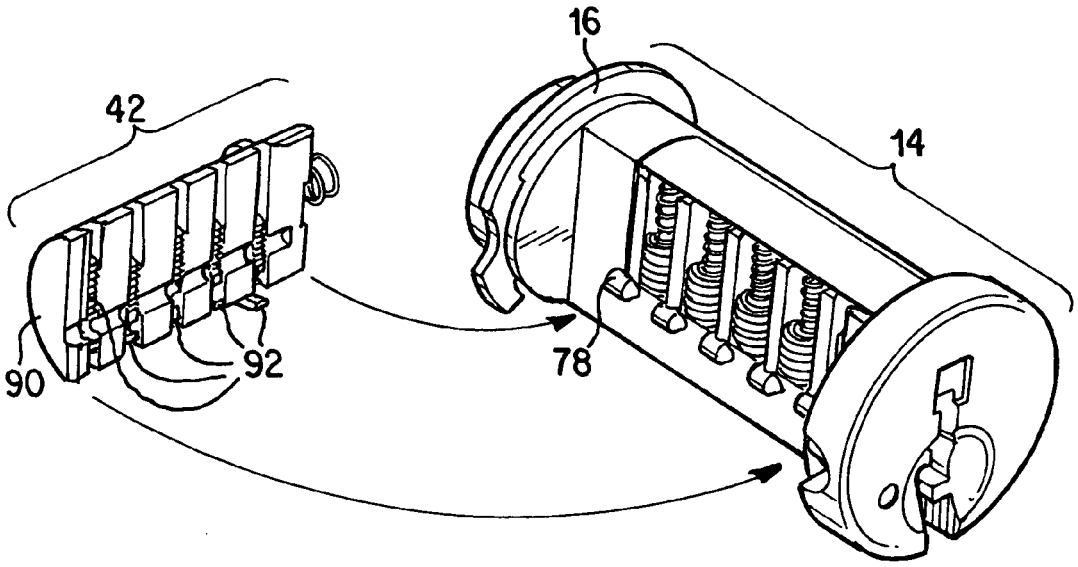
FIG. 6 is a partially exploded view of the plug assembly of FIG. 3.

The properly keyed lock cylinder 10, without the key 160 inserted, is illustrated in FIGS. 4-7. The pins 113 are biased to the bottom of the channels 74 and, based on the cut of the key 160, the racks 92 are disposed at various positions in the slots 102 of the carrier 90. In this configuration, the locking bar 94 extends from the carrier 90 to engage the groove 29 in the cylinder body 12 to prevent the plug assembly 14 from rotating in the cylinder body 12 and the racks 92 engage the pins 113, as illustrated in FIG. 4. In addition, the bullet-shaped features 78 are misaligned with the recesses 111 in the racks 92 and therefore interfere with movement of the racks 92 parallel to the longitudinal axis of the lock cylinder 10, preventing the lock cylinder 10 from being rekeyed.

Figure 8:
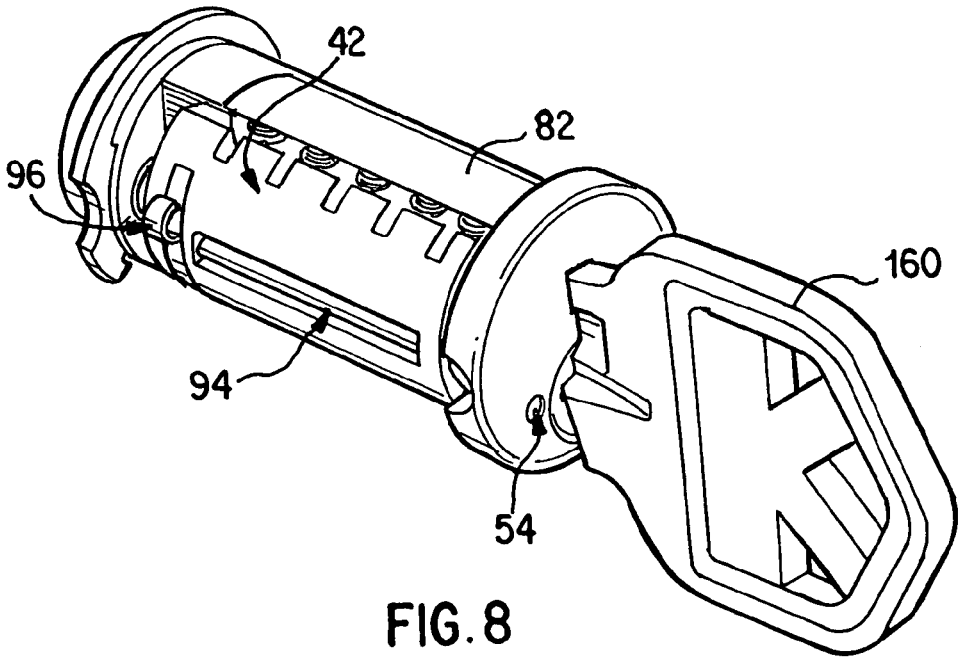
FIG. 8 is a perspective view of the plug assembly of FIG. 3 with a valid key inserted therein and illustrating the locking bar disposed in an unlocking position to allow the plug assembly to rotate in the lock cylinder body.
Figure 9:
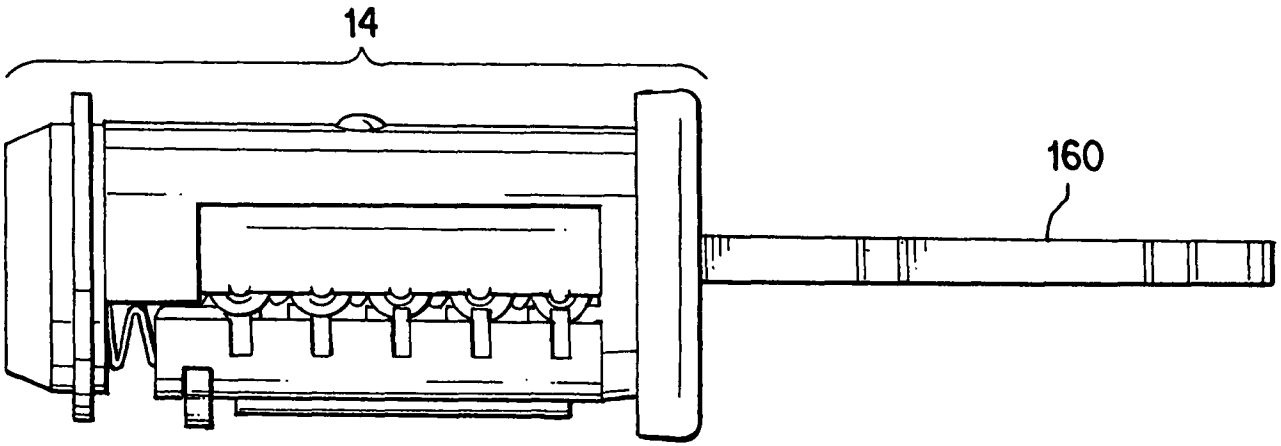
FIG. 9 is a top plan view of the plug assembly of FIG. 8.
Figure 10:
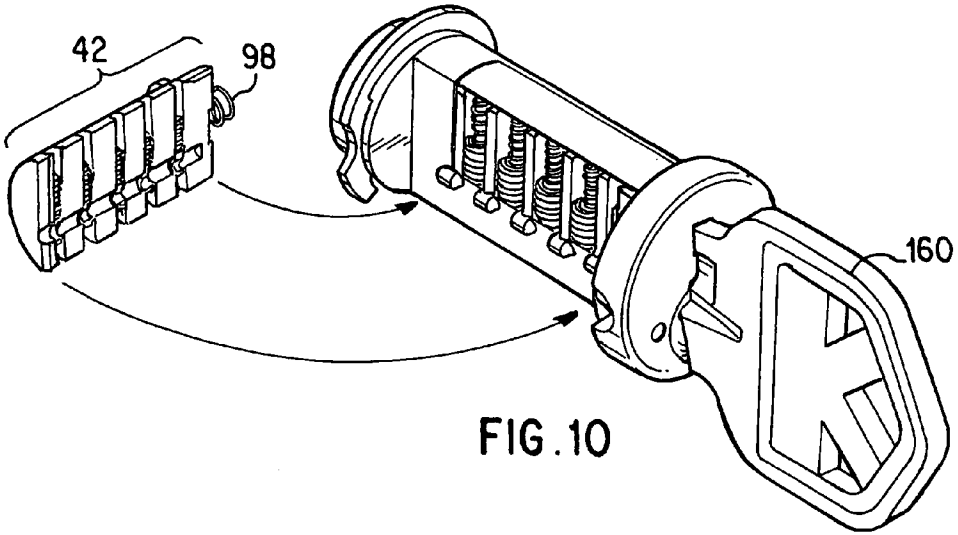
FIG. 10 is a partially exploded view of the plug assembly of FIG. 8.
Figure 11:
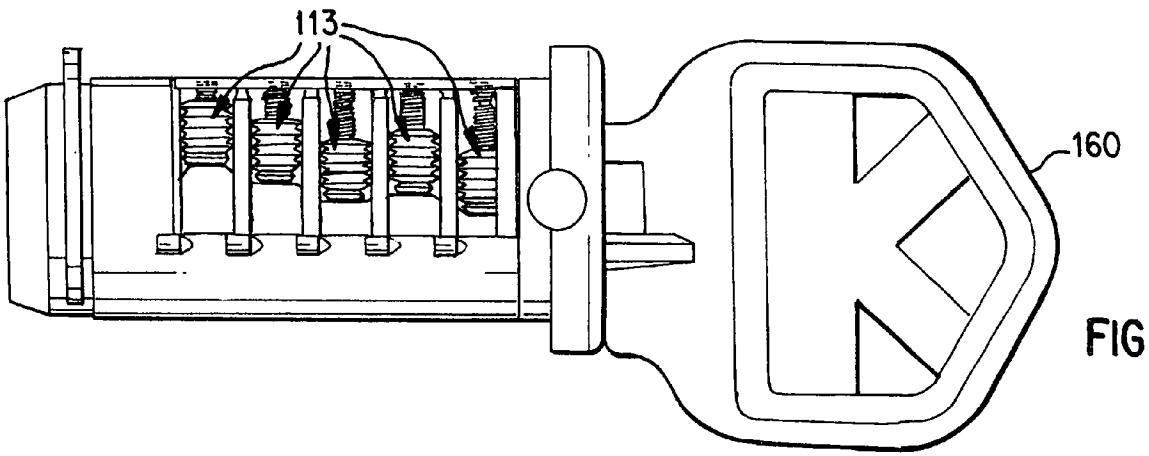
FIG. 11 is a partially broken away side view of the plug assembly of FIG. 8.

The internal configuration of a lock cylinder 10 with the valid key 160 inserted therein at the home position is illustrated in FIGS. 8-12. In this configuration, the locking bar 94 is free to cam out of the groove 29 in the cylinder body 12, as depicted in FIGS. 8, 9 and 12. The bits of the key 160 lift the pins 113 in the channels 74 and thereby re-position the racks 92 in the slots 102. When repositioned, the racks 92 are disposed to align the locking bar-engaging grooves 132 with the extended gear teeth 136 on the locking bar 94. The locking bar 94 is free to cam out of the groove 29 as the key 160 is rotated. At the same time, the bullet-shaped features 78 are aligned with the recesses 111 in the racks 92, as illustrated in FIG. 12, allowing the racks 92, and the carrier 90, to move parallel to the longitudinal axis of the lock cylinder 10.

Figure 13:
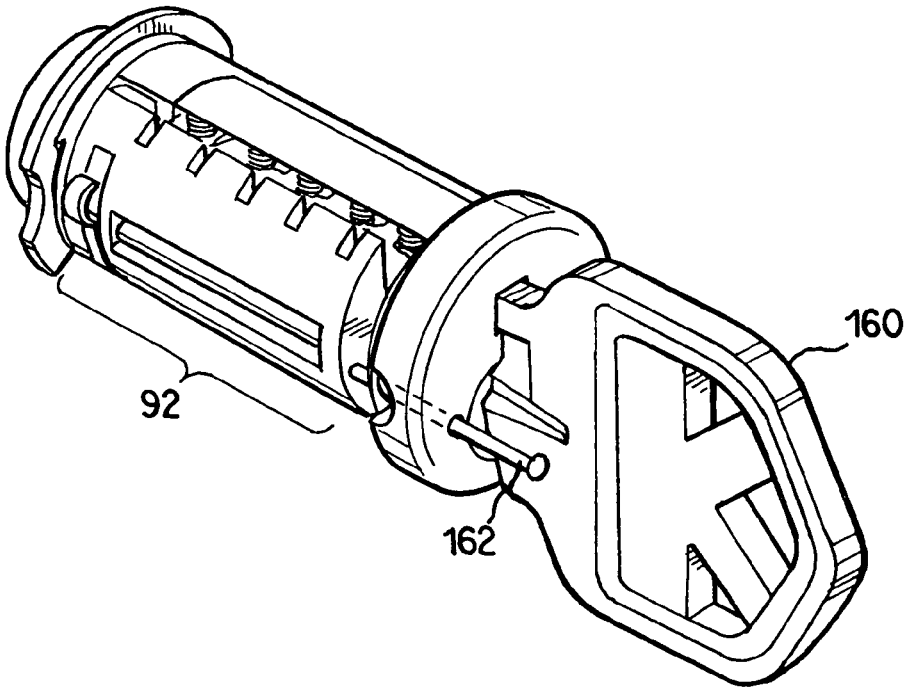
FIG. 13 is a perspective view similar to FIG. 8 but with the carrier assembly moved axially to a learn position.
Figure 14:
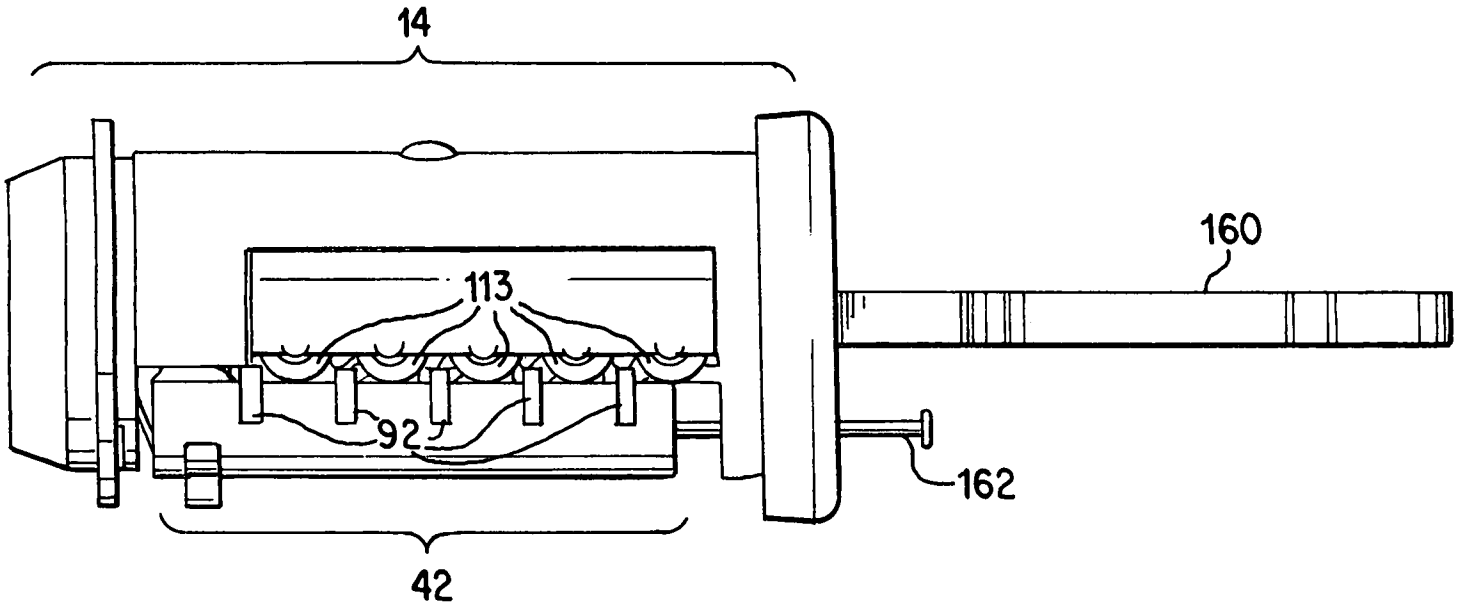
FIG. 14 is a top plan view of the plug assembly of FIG. 13.
Figure 15C:
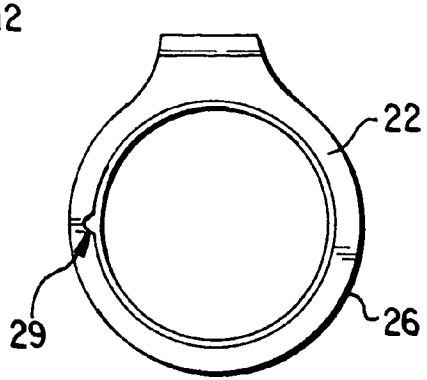
FIGS. 15*a*-15*e* are various views of a cylinder body.
Figure 15B:
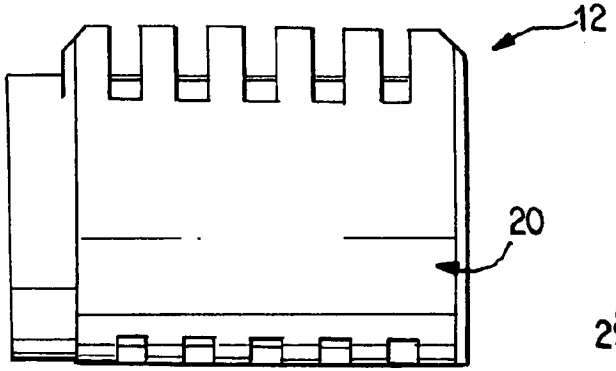
Figure 15A:
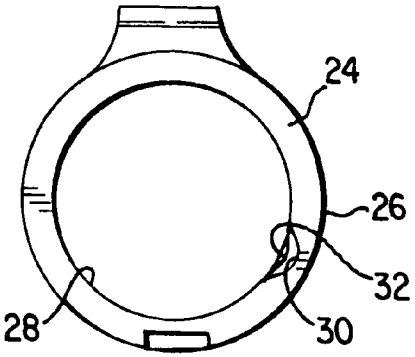
Figure 15E:
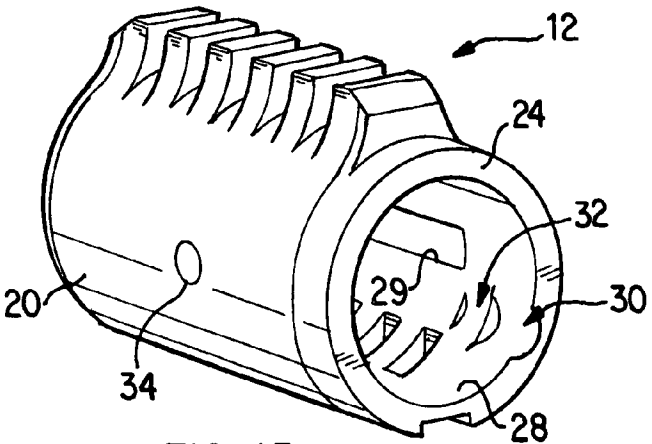
Figure 15D:
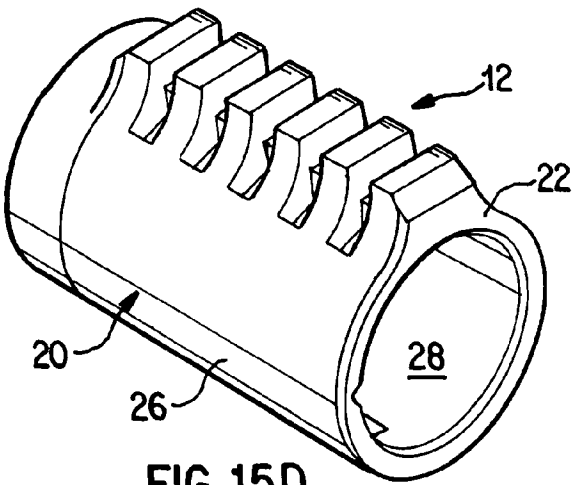
Figure 16A:
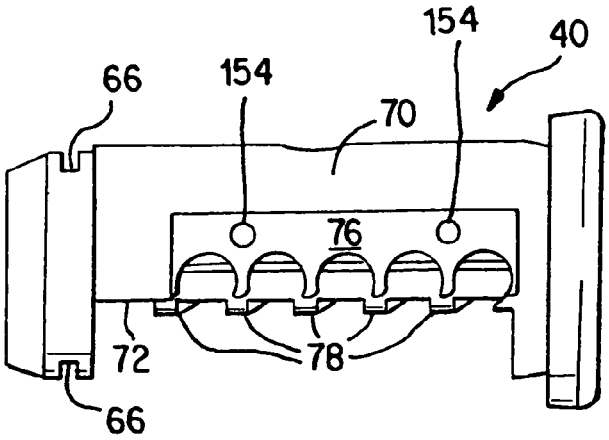
Figure 16B:
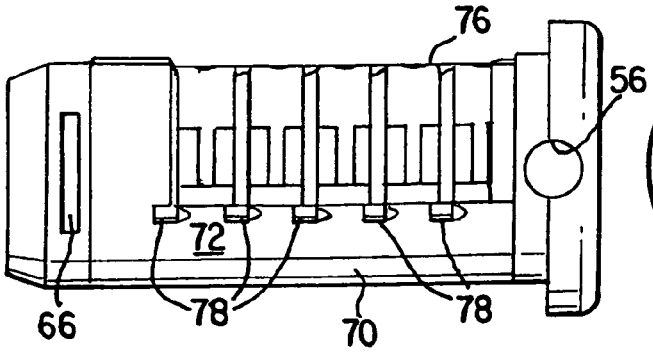
Figure 16C:
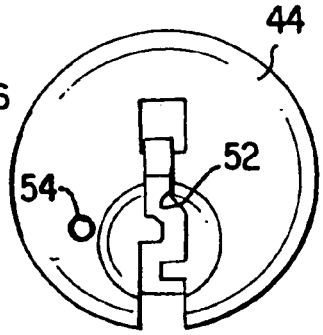
Figure 18A:
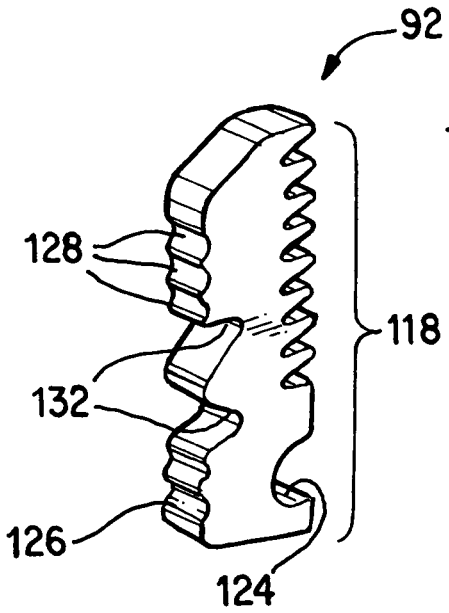
FIGS. 18*a*-18*b* are views of a rack.
Figure 18B:
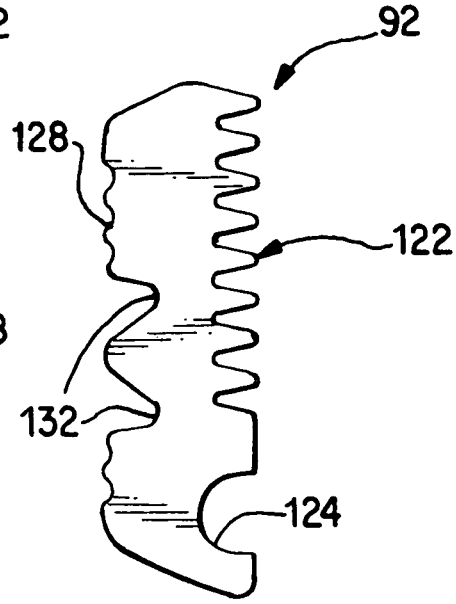
Figure 19A:
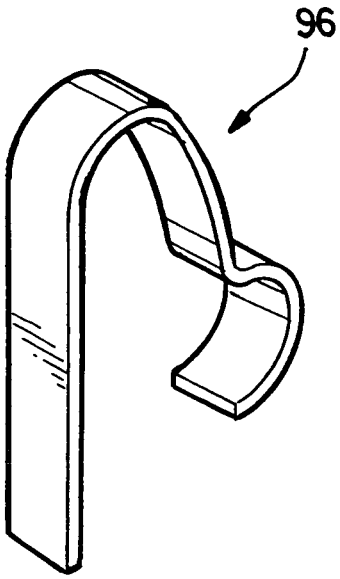
FIGS. 19*a*-19*b* are views of a spring catch.
Figure 19B:
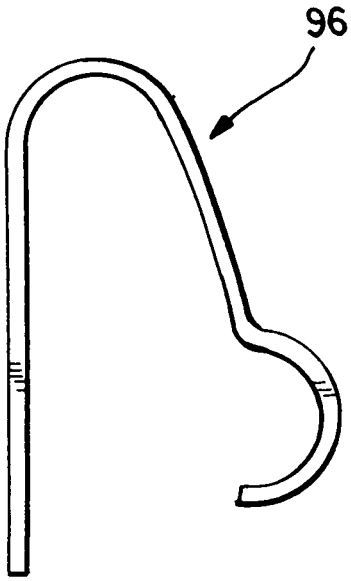
Figure 22A:
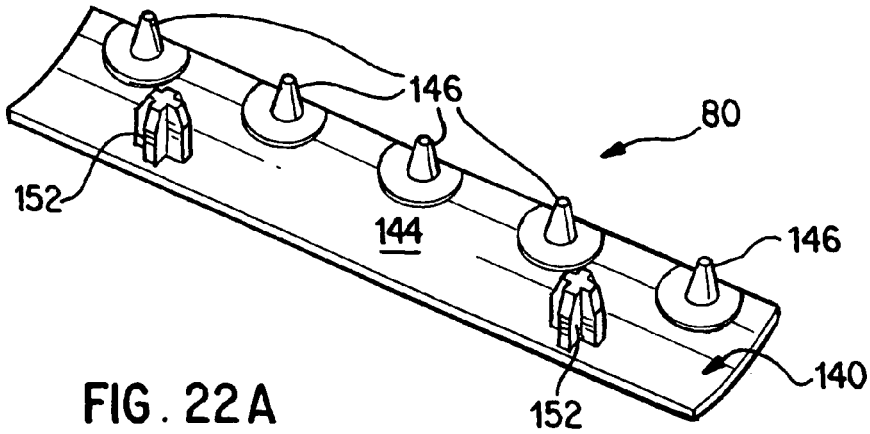
FIGS. 22*a*-22*d* are views of a spring retaining cap.
Figure 22B:
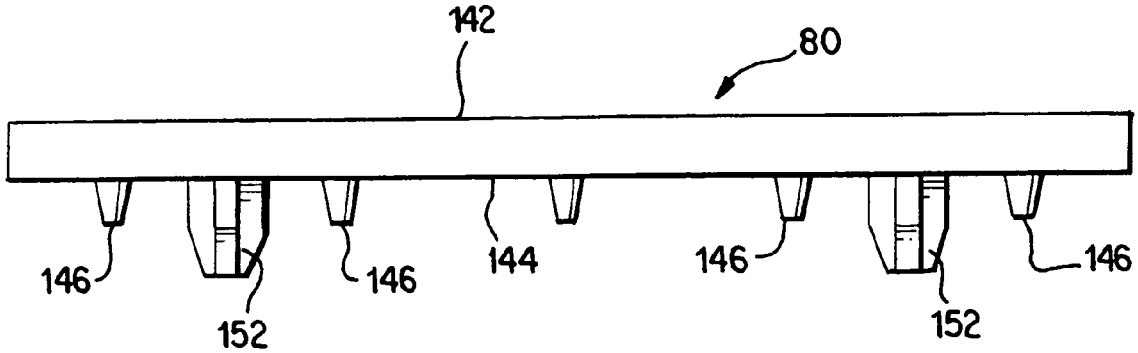
Figure 22C:
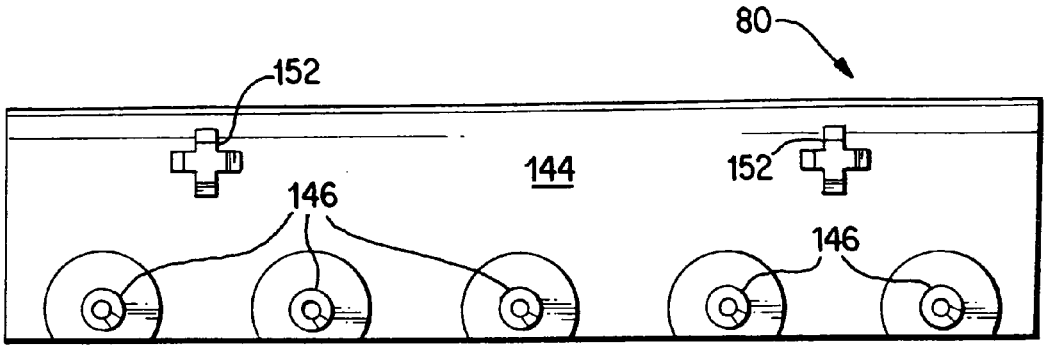
Figure 22D:
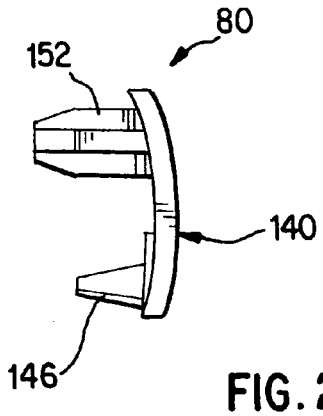

To rekey the lock cylinder 10, the valid key 160 is inserted into the keyway 52, as illustrated in FIGS. 13-14 and rotated approximately 45°-90° counterclockwise from the home position until the spring catch 96 moves into the second detent recess 32 formed in the cylinder body 12. A bracing bar 162, which can be in the form of a paperclip or other pointed device, is inserted into the tool opening 54 and pushed against the carrier 90 to move the carrier 90 parallel to the longitudinal axis of the lock cylinder 10 until the spring catch 96 moves into the first detent recess 30, and the pointed device 162 is removed. With the spring catch 96 disposed in the first detent recess 30, the racks 92 are disengaged from the pins 113, as illustrated in FIG. 14. The valid key 160 is removed and a second valid key is inserted and rotated clockwise to release the spring catch 96.

As the spring catch 96 leaves the first detent recess 30, the carrier 90 is biased toward the plug face 44 by the return spring 98, causing the racks 92 to re-engage the pins 113. At this point, the lock cylinder 10 is keyed to the second valid key and the first valid key 160 no longer operates the lock cylinder 10. The lock cylinder 10 can be rekeyed to fit a third valid key by replacing the first and second valid keys in the above procedures with the second and third valid keys, respectively.

Figure 23:
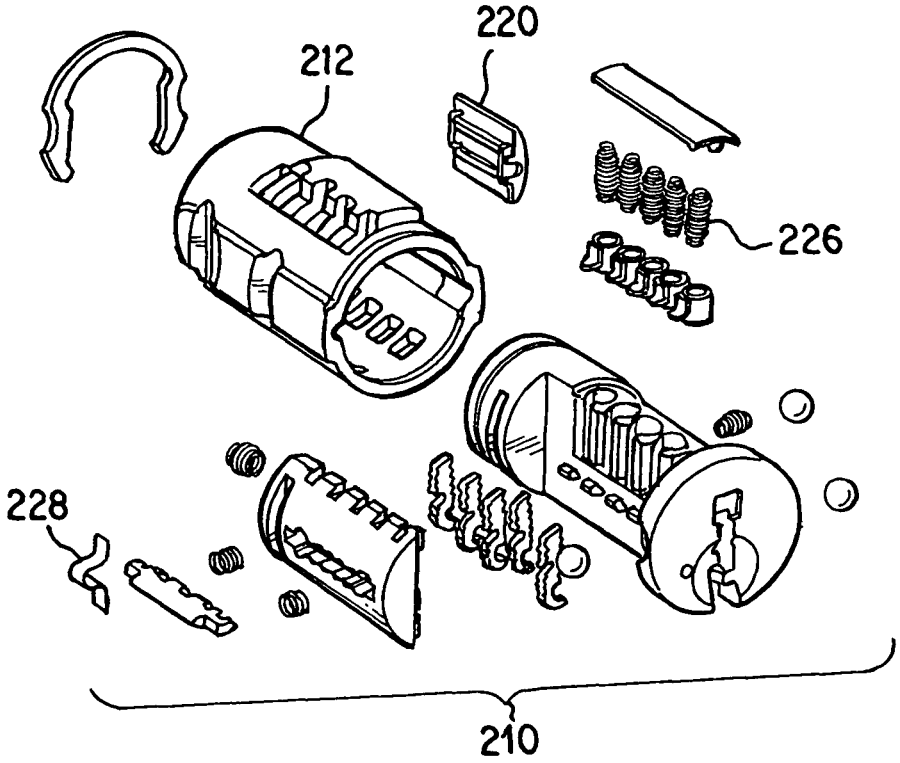
FIG. 23 is an exploded perspective view of an alternative embodiment of the lock cylinder.
Figure 24A:
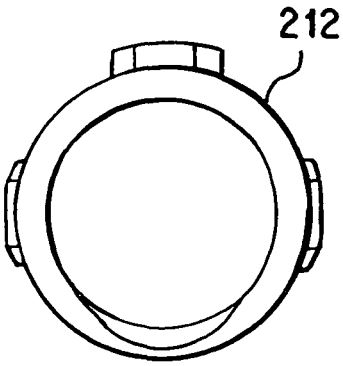
FIGS. 24*a*-24*e* are views of an alternative embodiment of the lock cylinder housing.
Figure 24B:
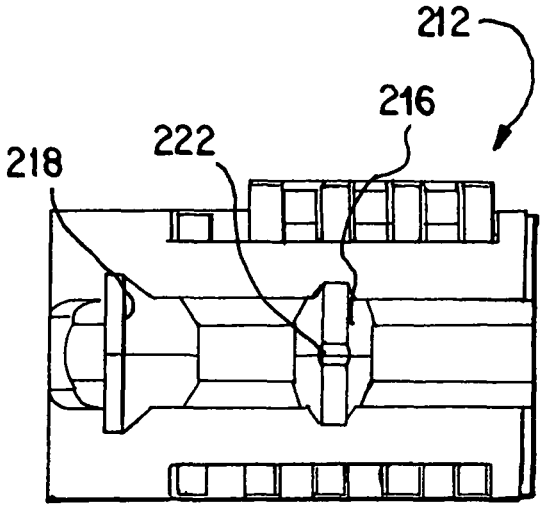
Figure 24C:
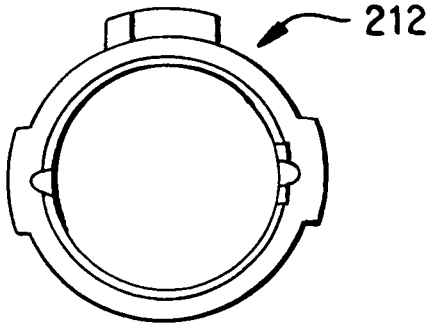
Figure 24D:
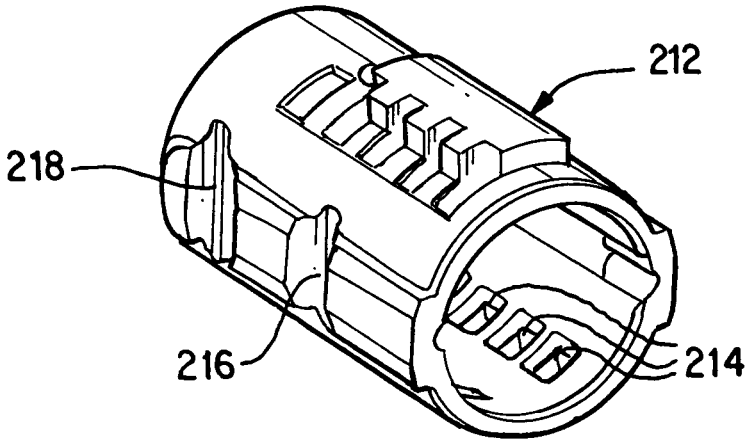
Figure 24E:
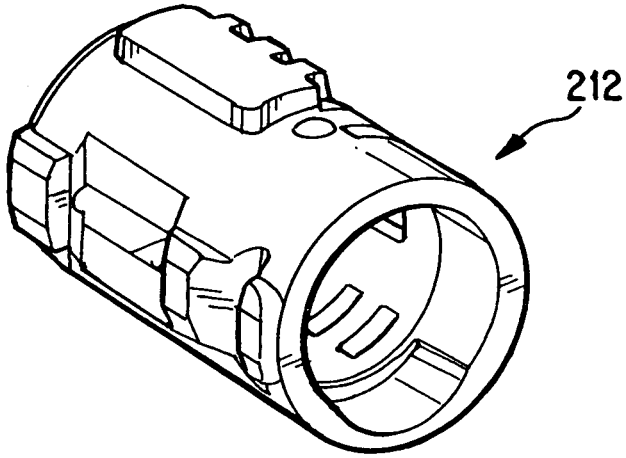

An alternative exemplary embodiment 210 is illustrated in FIGS. 23-30. The alternative embodiment includes the same components, as illustrated in FIG. 23, but several of the components have been modified. Functionally, both embodiments are the same.

The modified housing 212, illustrated in FIGS. 23 and 24, includes a plurality of apertures 214 running longitudinally along the bottom thereof and a pair of vertical grooves 216, 218 formed in the housing sidewall. In addition, the sidewall includes a removable side panel 220. The rectangular holes 214 are positioned to allow the use of a manual reset tool. The center groove 216 includes an aperture 222 extending through the housing sidewall. The aperture 222 allows a user to move the locking bar during a manual reset tool operation. The side panel 220 provides access for performing certain operations while changing the master key of the lock cylinder.

Figure 25:
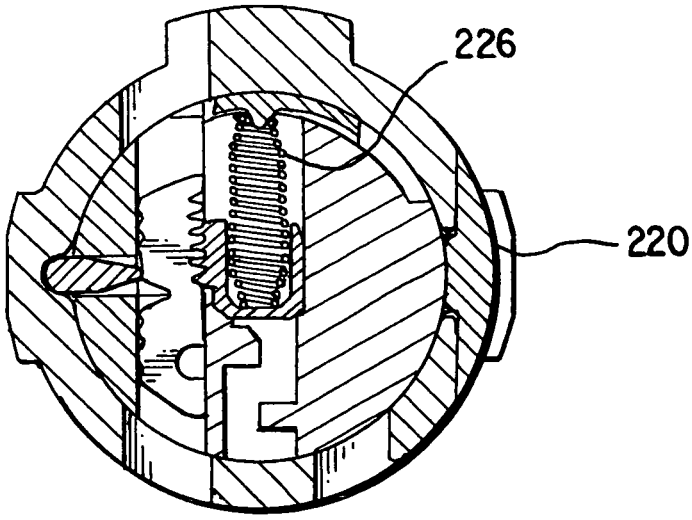
FIG. 25 is a transverse section view taken through the alternative embodiment of the lock cylinder.

The modified pin biasing springs 226, illustrated in FIGS. 23 and 25, include a non-constant diameter, with the last few coils at each end of the springs 226 having a reduced diameter. The tapering allows for a greater spring force in a smaller physical height.

Figure 26A:
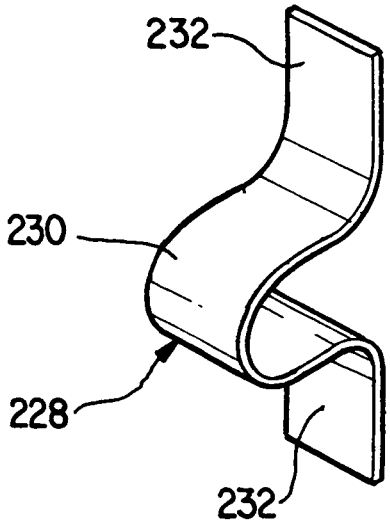
FIGS. 26*a*-26*b* are views of an alternative embodiment of the spring catch.
Figure 26B:
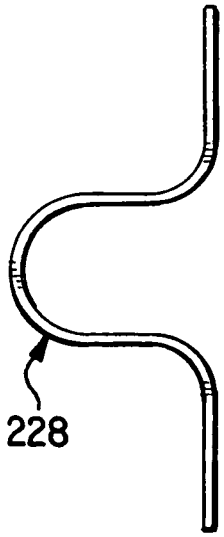
Figure 27A:
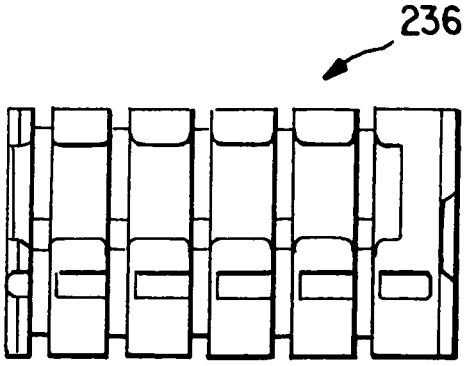
FIGS. 27*a*-27*b* are views of an alternative embodiment of the carrier.
Figure 27B:
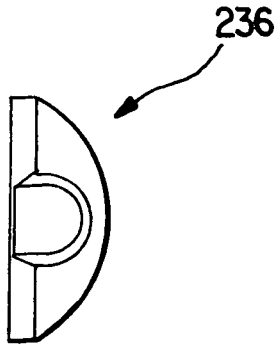
Figure 27C:
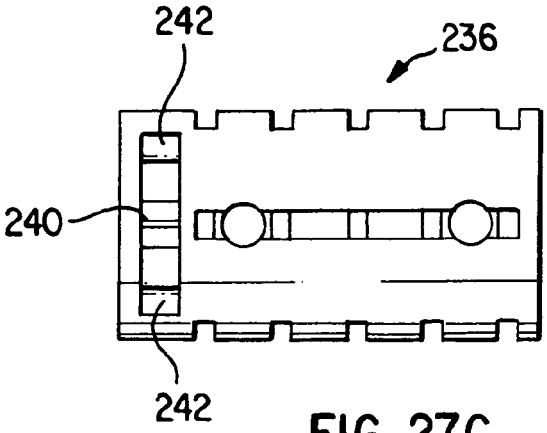
Figure 27D:
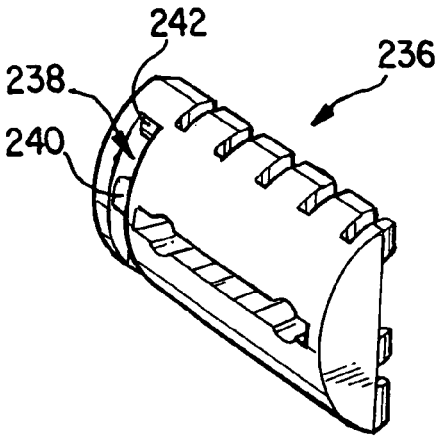
Figure 27E:
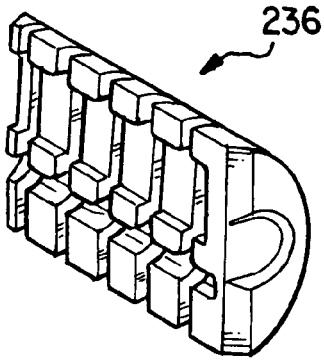

The modified spring catch 228, illustrated in FIGS. 23 and 26, includes a central U-shaped portion 230 and a pair of arms 232 extending from the U-shaped portion 230.

The modified carrier 236, illustrated in FIGS. 23 and 27, includes means for retaining the spring catch 228 in the spring catch recess 238. In the illustrated embodiment, this includes a guide 240 projecting outwardly in the center of the spring catch recess 238 and a pair of anchors 242 radially offset from the guide 240. The guide 240 prevents the spring catch 228 from moving transversely in the recess 238 while permitting it to move radially outwardly to engage the housing 12, 212 as described above. The anchors 242 engage the arms 232 of the spring catch 228 and prevent the arms 232 from splaying outwardly, thereby directing the compressive force of the spring catch 228 to extend the U-shaped portion 230 outwardly to engage the housing 12, 212.

The modified pins 244, illustrated in FIGS. 23 and 28, include a single gear tooth 246 instead of the plurality of gear teeth of the pins 113 described above. The single gear tooth 246, which preferably includes beveled sides 248, provides for a smoother engagement with the racks during the rekeying process.

The modified racks 250, illustrated in FIGS. 23 and 29, include beveled gear teeth to improve the engagement with the pins during the rekeying process. In addition, the pair of locking bar-engaging grooves 132 in the racks 92 are replaced with a single locking bar-engaging groove 251.

Figure 30A:
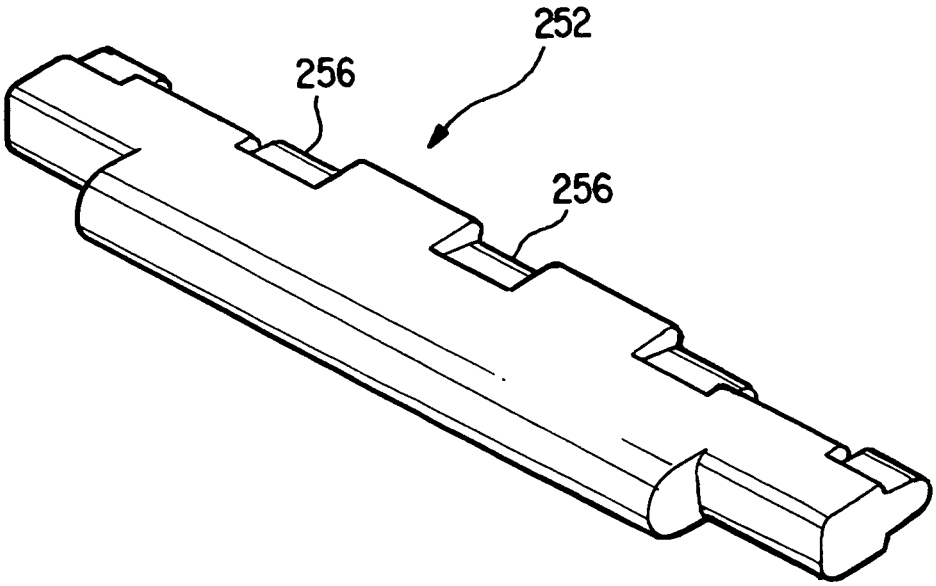
FIGS. 30*a*-30*b* are views of an alternative embodiment of the locking bar.
Figure 30B:
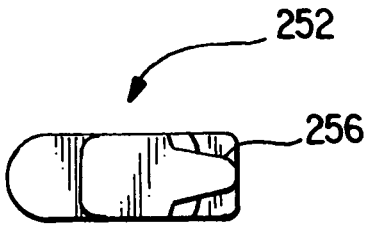

The modified locking bar 252, illustrated in FIGS. 23 and 30, is thinner than locking bar 94 and replaces the pair of gear teeth 136 with a single gear tooth 256 and rounds out the triangular edge 134. The thinner design reduces any rocking of the locking bar 252 in the locking bar recess 106.

Figure 31:
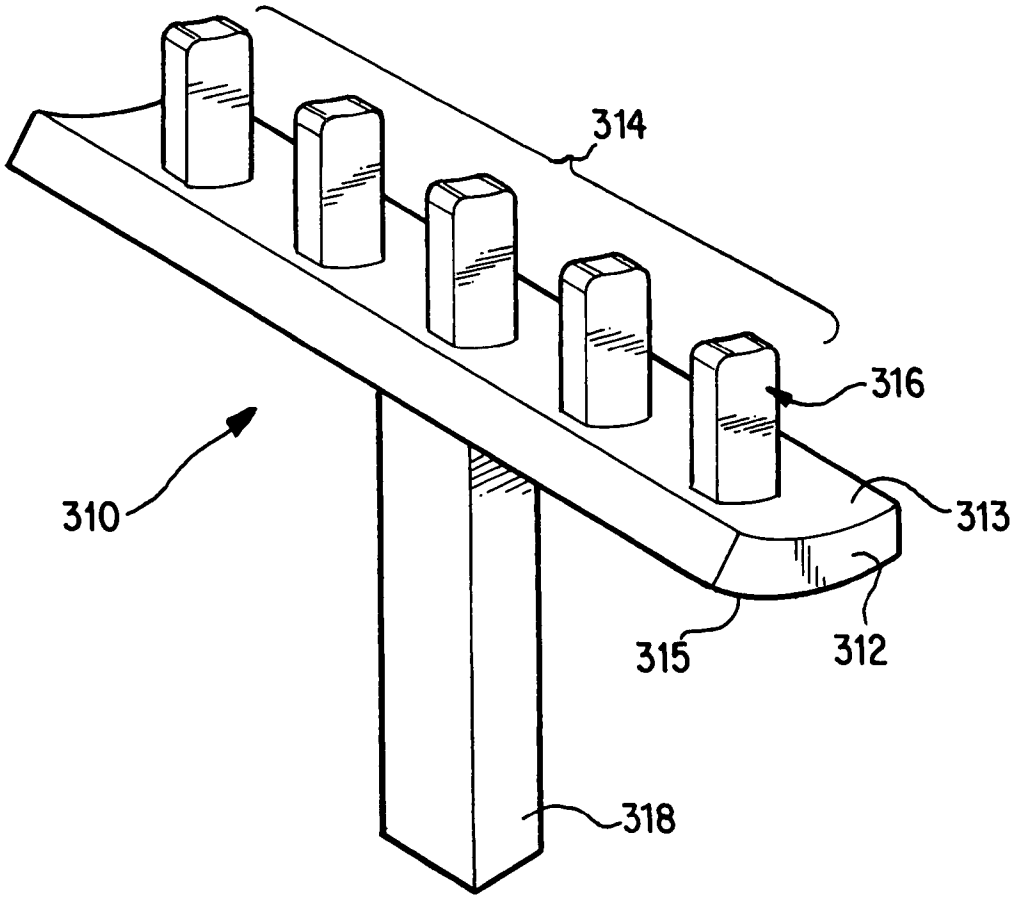
FIG. 31 is a perspective view of a reset tool.

FIG. 31 is a perspective view of an exemplary embodiment of a manual override or reset tool 310, which allows a user to put the lock cylinder into the learn mode without a valid key. The reset tool 310 can comprise a base 312 having, for example, a elongated approximately annular segment or elongated approximately toroidal segment shape. Attached to base 312 can be a plurality of prongs 314 each having, for example, an elongated approximately rectangular shape. Each of prongs 314 can be approximately perpendicularly attached to an inner surface 313 of base 312, and can have an end 316, that can have any shape that engages the a corresponding one of the plurality of racks 340 (shown in FIG. 34) of plug assembly 320, such as for example, a concave shape. A handle 318 can be attached to an outer surface 315 of base 312, the handle 318 having, for example, an elongated approximately rectangular shape. A longitudinal axis of handle 318 can be approximately perpendicular to and/or approximately parallel to a longitudinal axis of base 312. In an alternative embodiment (not shown), base 312 can have an elongated approximately rectangular shape, or any other shape, provided that base 312 serves to limit an insertion depth of reset tool 310 into the lock cylinder. Other features (not shown) can be formed on reset tool 310 to limit its insertion depth.

Figure 32:
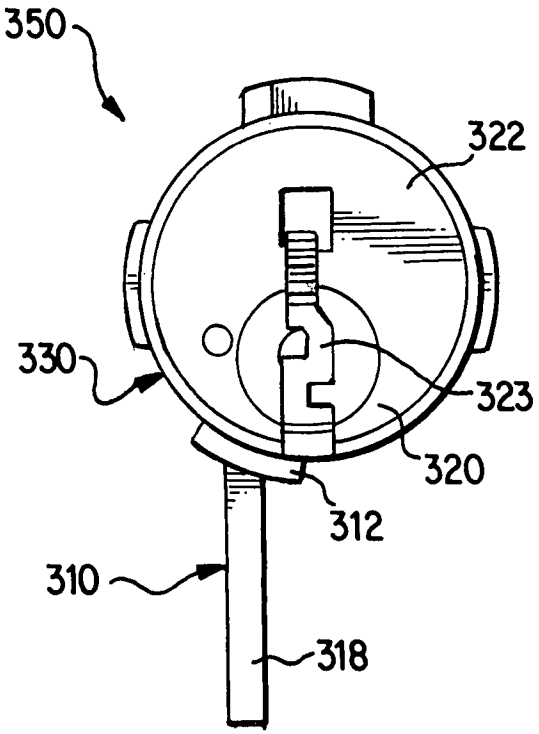
FIG. 32 is a front view of the reset tool engaged with the lock cylinder of FIG. 23.
Figure 33:
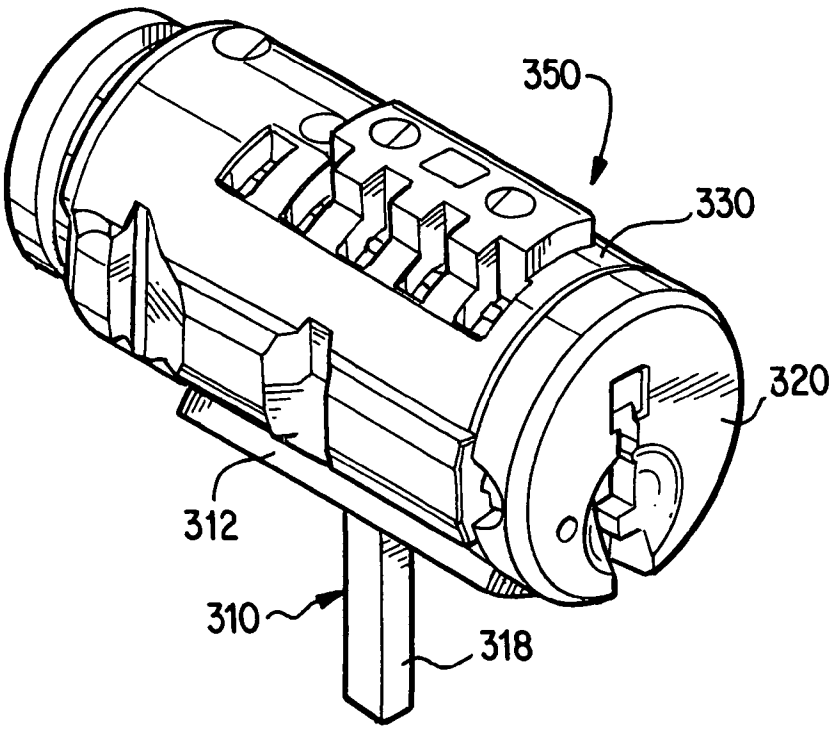
FIG. 33 is a perspective view of the reset tool engaged with the lock cylinder of FIG. 23.

FIG. 32 is a front view, and FIG. 33 is a perspective view of an exemplary embodiment of a reset tool 310 engaged with a lock cylinder 350. Referring to FIGS. 32 and 33, reset tool 310 can be inserted into lock cylinder 350 such that handle 318 is parallel to a keyway 323 defined through a plug face 322 of plug assembly 320. Base 312 can be configured to approximately conform to an outer surface of cylinder assembly 330.

Figure 34:
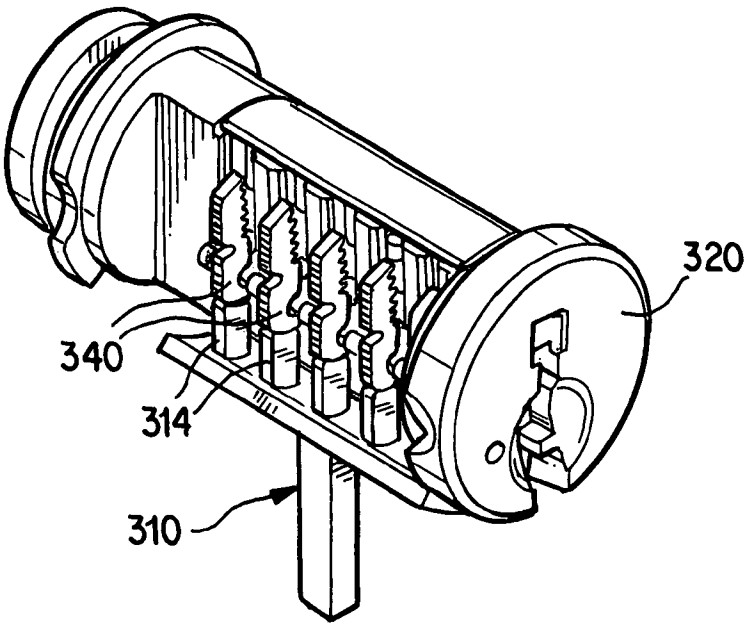
FIG. 34 is a partially exploded view of the reset tool engaged with the lock cylinder.

FIG. 34 is a partially exploded view of an exemplary embodiment of a reset tool 310 engaged with an embodiment of a lock cylinder 350. Note that prongs 314 can engage racks 340 and align them to a common level.

Figure 37:
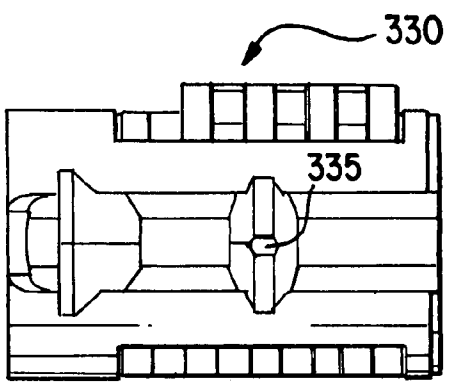
FIG. 37 is a top view of the cylinder body.
Figure 36:
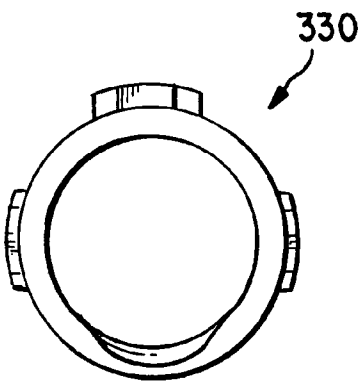
FIG. 36 is a rear view of the cylinder body.
Figure 35:
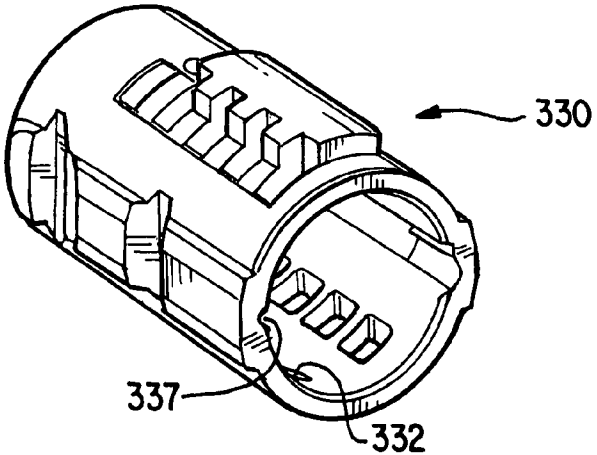
FIG. 35 is a front perspective view of the cylinder body.
Figure 39:
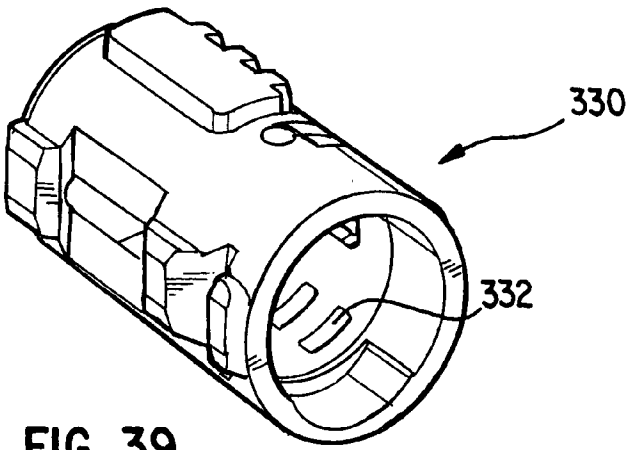
FIG. 39 is a rear perspective view of the cylinder body.
Figure 38:
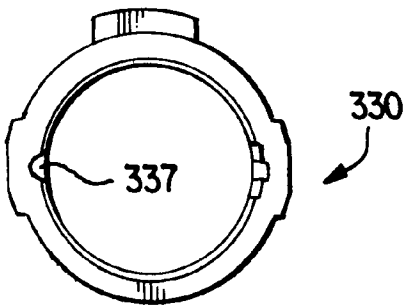
FIG. 38 is a front view of the cylinder body.

FIG. 35 is a front perspective view, FIG. 36 is a rear view, FIG. 37 is a side view, FIG. 38 is a front view, and FIG. 39 is a rear perspective view of an exemplary embodiment of a cylinder body 330. Referring to FIGS. 34-39, cylinder body 330 can define a plurality of reset tool apertures 332 that can allow reset tool 310 to access the plurality of racks of plug assembly 320. Cylinder body 330 can also define a locking bar access aperture 335 via which a bracing bar 360 (shown in FIG. 40) can access and/or dislocate a locking bar 94 (shown at least in FIGS. 2, 3, 7, 8, 12, and 21A) from engaging with locking bar recess 337 of cylinder body 330.

Figure 40:
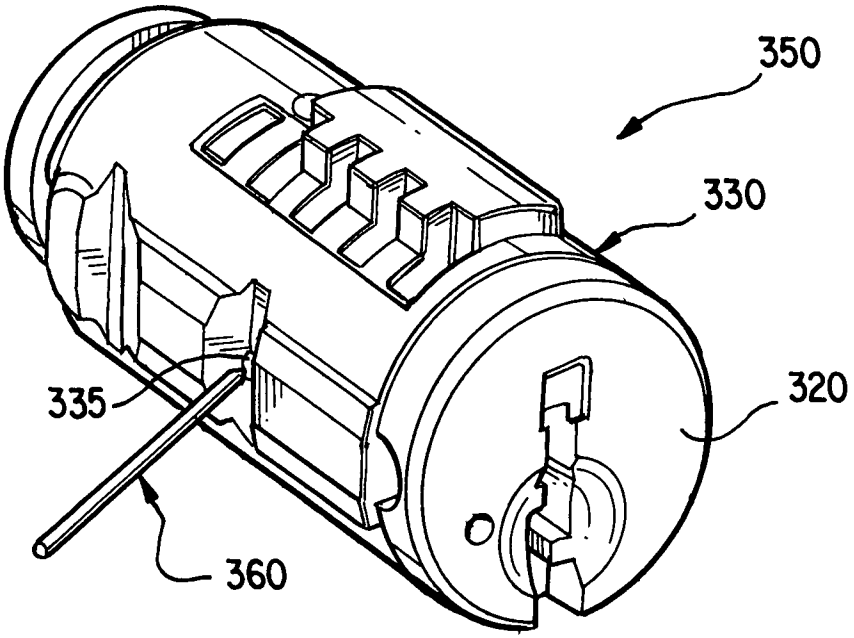
FIG. 40 is a perspective view of a bracing tool engaged with a lock cylinder.

FIG. 40 is a perspective view of an exemplary embodiment of a bracing bar 360 engaged with an exemplary embodiment of a lock cylinder 350. Bracing bar 360, which can be as simple as a paperclip, can be inserted through locking bar access aperture 335 defined in cylinder body 330, such that locking bar 252 (in the manner illustrated in FIG. 12) can engage with racks 250 to align, restrict, and/or limit travel of, pins 244.

Figure 41:
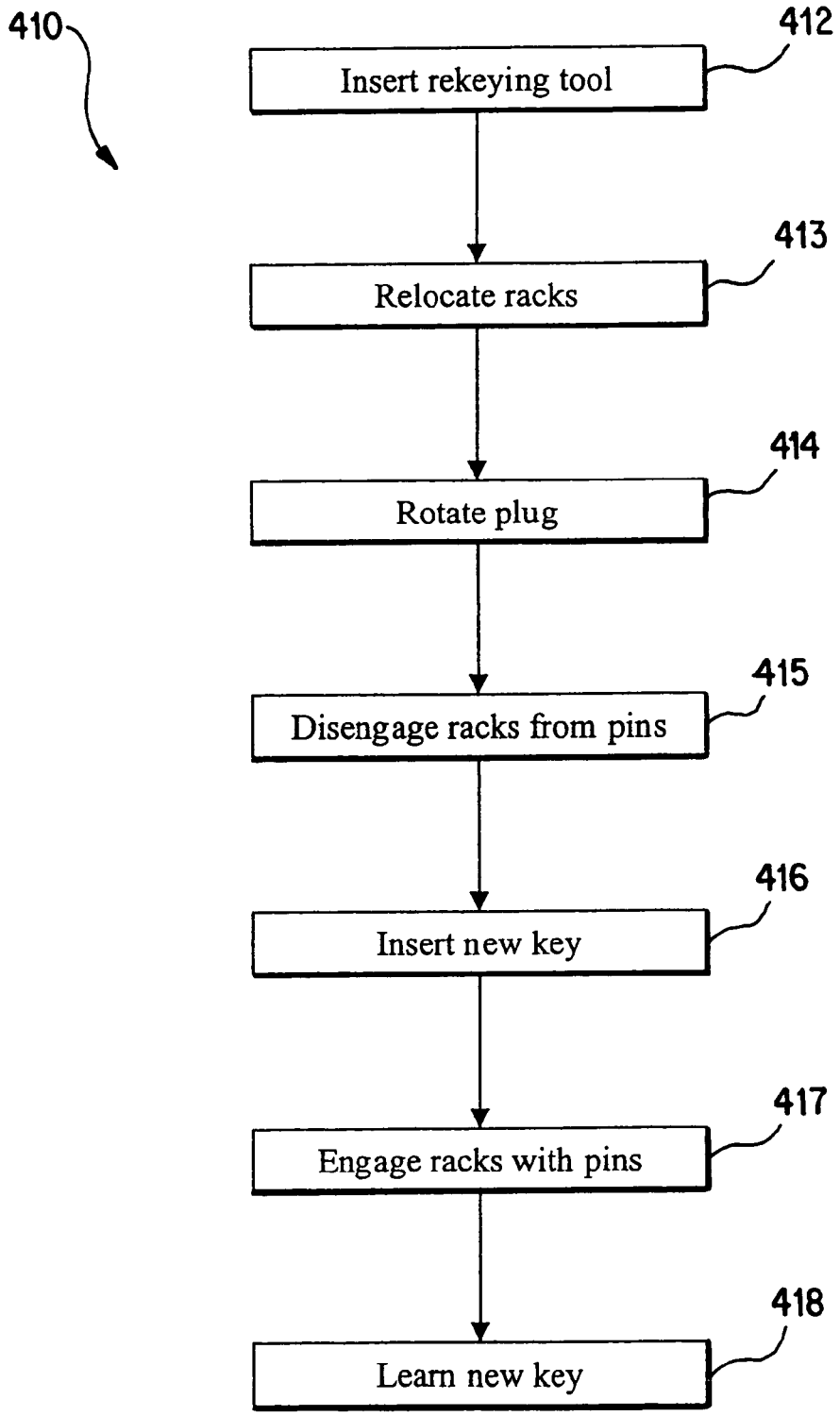
FIG. 41 is a flow chart of a method of rekeying the lock cylinder of FIG. 23.

FIG. 41 is a flow chart of an exemplary embodiment of a rekeying method 410. At activity 412, a reset tool 310 can be inserted through one or more apertures 332 of the cylinder body 330, such that the prongs 314 of the reset tool 310 engage the racks 250 of the plug assembly 320. The insertion depth of the reset tool 310 can be limited by the geometry of the reset tool, such as a shape of the base of the reset tool or a prong length, and/or the geometry of the cylinder body and/or plug assembly. For example, if the cylinder body has a elongated circular exterior, an interior and/or contact surface of the base of the reset tool can be shaped as an elongated annular segment, the inner radius of that segment approximately matching an outer radius of the cylinder body.

At activity 413, the reset tool 310 can relocate the plurality of racks 250, such that the racks 340 are aligned at a common level. For example, each rack can have a reference point, and full insertion of the reset tool can cause each reference point to align along a line parallel to an axis of the cylinder body and/or the plug assembly. As another example, referring to FIG. 12, each of the bullet-shaped features 78 can be aligned with the recesses 111 in the racks 92, allowing the racks 92, and the carrier 90, to move parallel to the longitudinal axis of the lock cylinder 10. Referring to FIGS. 12 and 40, with the racks 92 aligned, a bracing bar 360 can be inserted into a locking bar access aperture 335 in the cylinder body 330 to cause the locking bar 252 to engage with cut-outs 251 in the racks 250, thereby preventing relative movement among the racks, and consequently, relative movement between the pins 244 engaged with the racks 250 and allow the plug assembly to rotate in the cylinder body.

At activity 414, with the racks thus "locked" by the locking bar 252, the reset tool 310 can be removed from the lock assembly. Then, the plug assembly 320 can be rotated within the cylinder body 330 to a rekeying position. This rotation can occur without requiring the use of a valid key, and can occur with the use of any key. As the plug assembly 320 is rotated approximately 90° counterclockwise, the locking bar 252 is retained in engagement with the racks 250. The plug assembly 320 is now in the rekeying position.

At activity 415, with the plug assembly in the rekeying position, the racks can be disengaged from the pins by pushing the racks away from the pins. Referring to FIGS. 13 and 14, a learn tool, such as a paperclip or other pointed device 162, can be inserted into the tool opening 54 and pushed against the carrier to move the carrier parallel to the longitudinal axis of the lock cylinder to a learn position, where the spring catch moves into the first detent recess, and the pointed device 162 is removed. With the spring catch disposed in the first detent recess, carrier is locked in place by the spring catch, the racks are disengaged from the pins, and the racks are locked in place by the bullet-shaped features 78 (shown in FIG. 6).

At activity 416, a key, which may or may not be key 160, can be inserted into the keyway of the plug assembly. As the key is inserted, the pins can ride up and down the ramps of the key. Once the key is fully inserted, the pin heights can correlate to the new key.

At activity 417, the racks can be re-engaged with the pins. The key can be rotated clockwise to release the spring catch. As the spring catch leaves the first detent recess, the carrier is biased toward the plug face by the return spring, causing the racks to re-engage the pins. At this point, the lock cylinder is keyed to the key and, if the key is different than key 160, then key 160 no longer operates the lock cylinder. Thus, the new key can be learned by rotating the plug assembly away from the learn position.

Thus, the reset tool can place the lock assembly into a learn mode, in which it can read and conform to a profile of a any valid key, without removing the plug assembly from the cylinder body.

Figure 42:
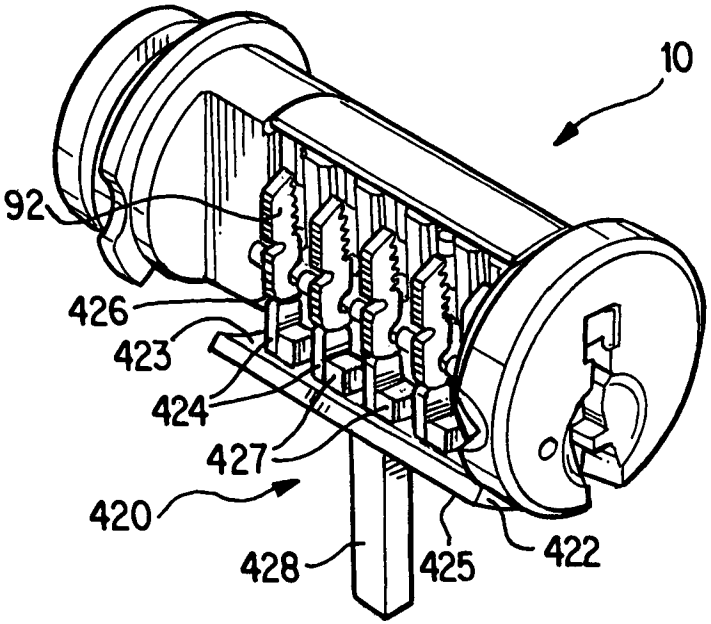
FIG. 42 is a partially exploded view of a reset tool engaged with a lock cylinder.

FIG. 42 is a partially exploded view of an exemplary embodiment of a reset tool 420 engaged with an exemplary embodiment of a lock cylinder 10. Reset tool 420 can be used to configure a lock cylinder to suit any appropriate key cut (occasionally a.k.a. "bit spacing"), including a competitor's key cut.

Reset tool 420 can be substantially identical to reset tool 310 (shown in FIG. 31), except that reset tool 420 can comprise a carrier retainer 427, that is shaped and/or dimensioned to at least partially fill its corresponding reset tool aperture 332 in cylinder body 330 (shown in FIG. 39), for instance while longitudinal ends 426 of keying tool's prongs 424 are engaged in rack apertures 103 (shown in FIG. 17A) in a dislocated carrier assembly 42 (shown at least in FIGS. 2, 4, 14).

Thereby, referring to FIGS. 2 and 42, reset tool 420 can prevent the dislocated carrier assembly 42 whose racks 92 are unengaged (possibly because they have not yet been inserted into carrier assembly 42) with their corresponding pins 113, from moving with respect to cylinder body 12 and/or from returning to its original position. That is, via insertion of reset tool 420 into a lock cylinder 10, a carrier assembly 42 that has been moved from a "normal" position to a "dislocated" position can be retained in place with respect to the cylinder body 12, thereby allowing racks 92 that are inserted into the carrier assembly 42 to remain unengaged from pins 113 until the carrier retainer portion 427 of reset tool 420 is removed from, and/or no longer at least partially fills, its corresponding aperture in cylinder body 12, and/or until reset tool 420 is removed from the lock cylinder 10. Reset tool 420 can also align the inserted racks 92 and/or a feature on the inserted racks 92 to a predetermined level.

Reset tool 420 can comprise a base 422 having, for example, an elongated annular segment or elongated toroidal segment shape. Attached to base 422 can be a plurality of prongs 424 each having, for example, an elongated approximately rectangular shape. Each of prongs 424 can be approximately perpendicularly attached to an inner surface 423 of base 422, and can have, for example, a concavely shaped end 426. To an outer surface 425 of base 422 can be attached a handle 428, having, for example, an elongated rectangular shape. A longitudinal axis of handle 428 can be approximately perpendicular to and/or approximately parallel to a longitudinal axis of base 422. In an alternative embodiment (not shown), base 422 can have an elongated rectangular shape, or any other shape, provided that base 422 serves to limit an insertion depth of keying tool 420 into the lock cylinder. As yet another alternative, another feature of tool 420, such as carrier retainer 427, can limit its insertion depth.

Each carrier retainer 427 can be adjacent, contiguous, and/or integral with a prong 424, and can have, for example, an elongated rectangular shape. The length of each carrier retainer 427 can be less than its corresponding prong 424. A combined width of each prong/carrier retainer, as measured in a direction parallel to the longitudinal axis of the plug body and/or along a line where the prong and carrier retainer combination attach to base 422, can be greater than a width of the prong 424. Referring to FIGS. 34-39, the orientation and width of at least one prong and carrier retainer combination can be sufficient to substantially fill at least the width of its corresponding rekeying tool aperture 332 in cylinder body 330, thereby preventing a dislocated carrier assembly 42 (shown at least in FIGS. 2, 4, 14) from returning to its original position.

As shown in FIGS. 28A and 28B, pin 244 can comprise standardized dimensions and shape, and can comprise a single tooth 246, located in a standard position. As shown in FIGS. 29A and 29B, rack 250 can have a tooth profile that meshes with pin 246, and having a spacing that corresponds to depth increments (occasionally a.k.a. "bit spacing") of the key cut. The tooth spacing of rack 250 can be customized to a particular manufacturer, brand, or model of key and/or lock assembly. For example, Schlage keys and locksets tend to have an 11 mil key cut increment, while Kwikset tends to use a 15 mil key cut increment. Thus, a rack 250 that is intended for use with a Schlage key could have an 11 mil tooth spacing, and a rack 250 that is intended for use with a Kwikset key could have a 15 mil tooth spacing.

Alternatively, either of two standard racks could be selected to correspond to a particular key cut depth. For example, assuming that Kwikset tends to use a 15 mil key cut increment, a first standard Kwikset rack A could have one or more tooth engagements zones (e.g., valleys) at, for instance, 15 mils, 45 mils, and 75 mils, as measured from a convenient location, such as one end of the rack. A second standard Kwikset rack B. could have valleys at 30 mils, 60 mils, and 90 mils. Depending on the depth of a particular key's cut for a given pin, the appropriate rack could be chosen. So if a key had a cut depth of 60 mils, a rack B could be selected and used for the corresponding pin.

Figure 43:
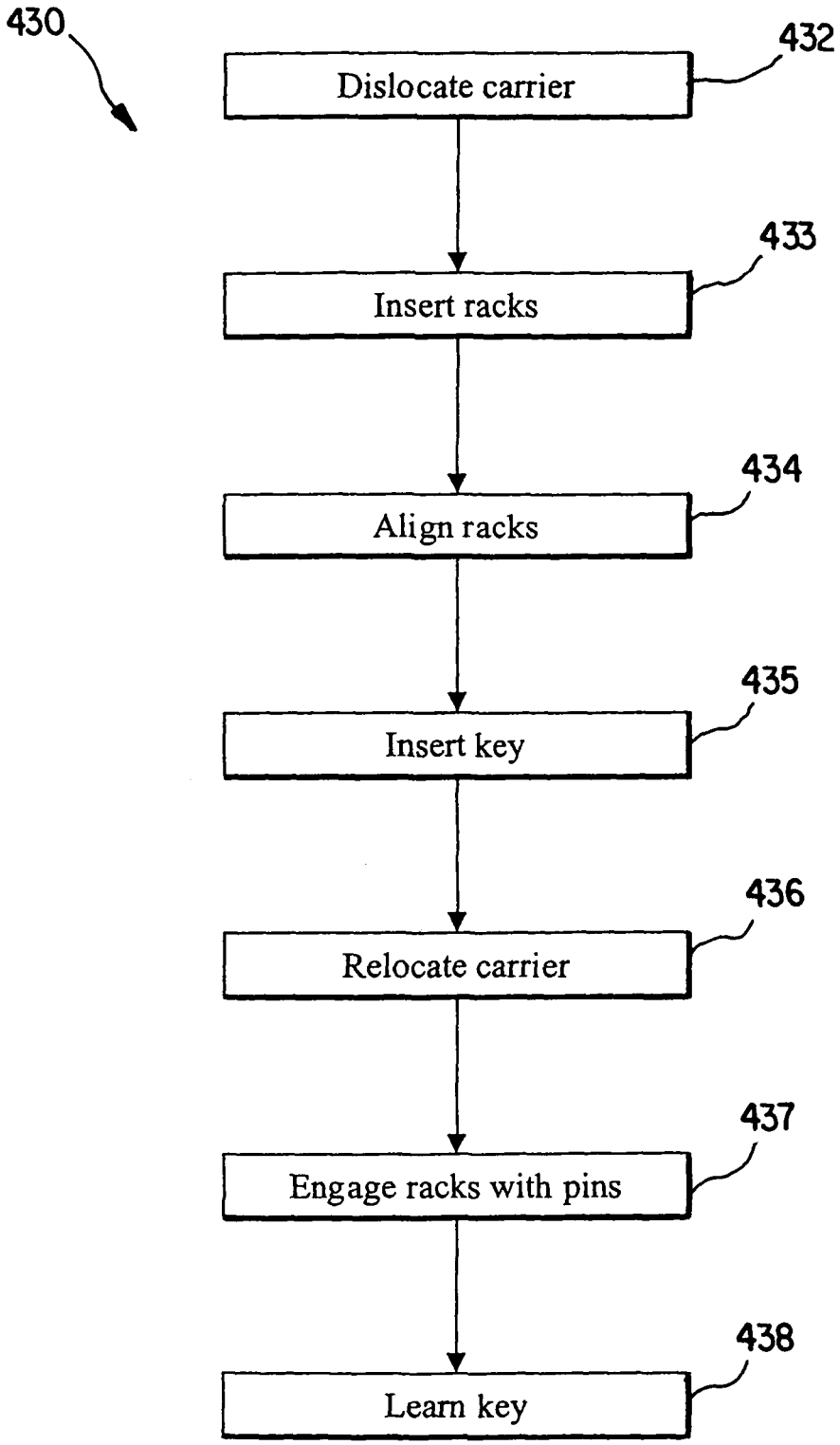
FIG. 43 is a flow chart of a rekeying method.
Figure 44:
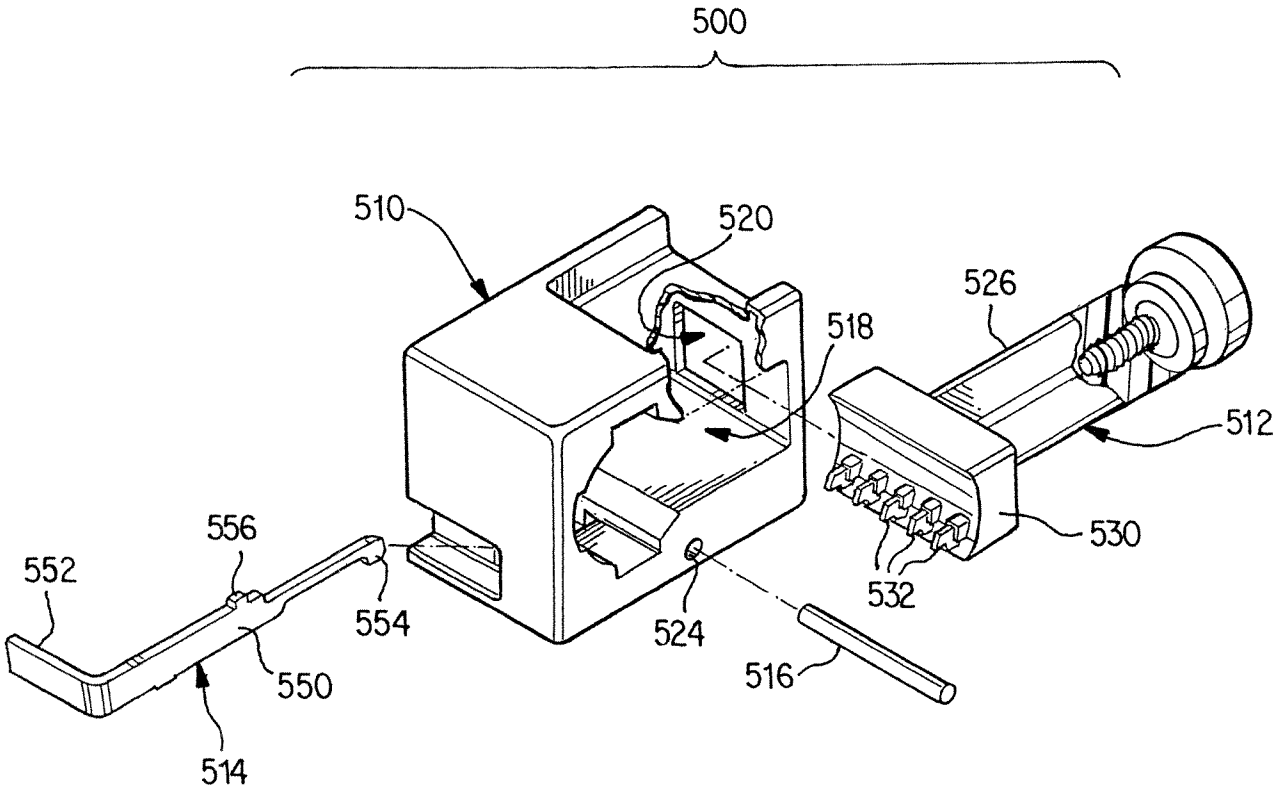
FIG. 44 is an exploded perspective view of an exemplary embodiment of a reset fixture illustrating a housing, a reset tool, bracing bar and pin are also shown.
Figure 45:
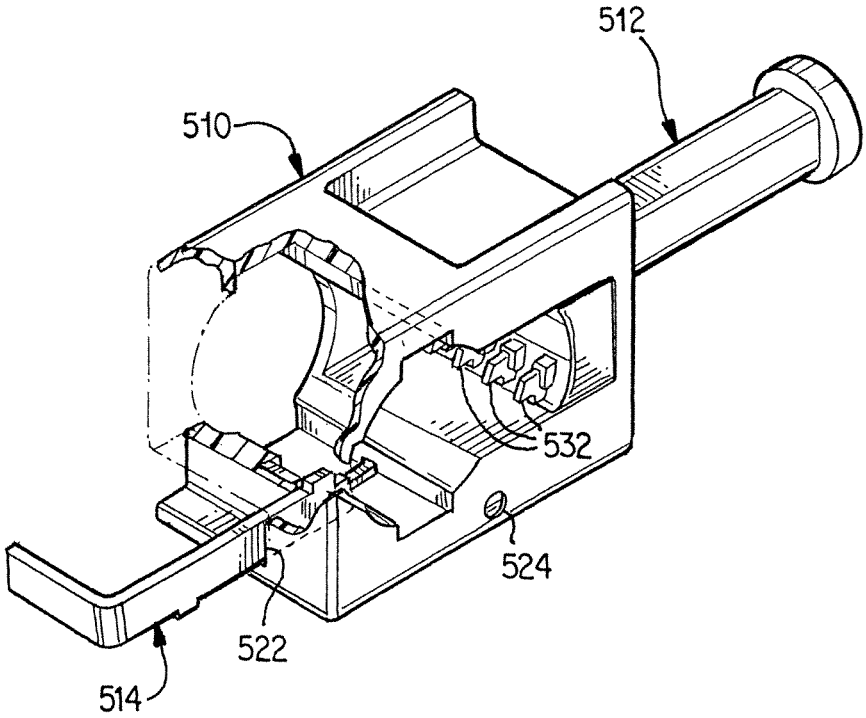
FIG. 45 is a partially broken away view of the housing shown in FIG. 44 with the reset tool and bracing bar inserted.
Figure 46:
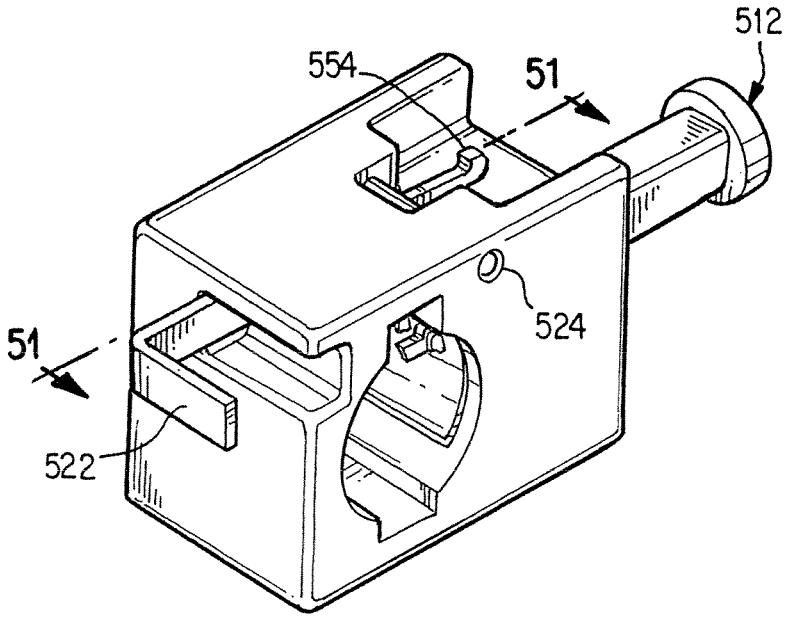
FIG. 46 is a perspective view taken from a rear face of the housing.

FIG. 43 is a flow chart of an exemplary embodiment of a rekeying method 430.

At activity 432, the rack carrier can be pushed away from the pins, such that it moves from a "normal" position to a "dislocated" position. This can be accomplished by inserting a learn tool, such as a paperclip, into an aperture found in a front face of the plug, such that the tool engages and pushes the carrier backward. With the carrier dislocated, a reset tool, such as that shown in FIG. 42, can be inserted into apertures in the cylinder body. Because the reset tool can retain the carrier in the dislocated position, the learn tool can now be removed.

The insertion depth of the reset tool can be limited by the geometry of the reset tool, such as a shape of the base of the reset tool or a prong length, and/or the geometry of the cylinder body and/or plug assembly. For example, if the cylinder body has a elongated circular exterior, an interior and/or contact surface of the base of the reset tool can be shaped as an elongated annular segment, the inner radius of that segment approximately matching an outer radius of the cylinder body.

At activity 433, the racks can be selected, potentially to correspond to a manufacturer, brand, and/or model of key and/or lock assembly, and/or to correspond to a key cut. The selected racks can be inserted into their respective slots of the carrier assembly. At activity 434, the reset tool can align the inserted racks.

At activity 435, a key can be inserted into the keyway of the plug assembly. As the key is inserted, the pins can ride up and down the ramps of the key to land and/or align with flats of the key. Once the key is fully inserted, the heights of the pins and/or the pin teeth can correlate to the profile of the key.

At activities 436 and 437, the racks can be engaged with the pins by removing the keying tool, such that the carrier spring biases and/or relocates the carrier back into its "normal" position.

At activity 438, the key can be learned by rotating the plug assembly away from the learn position.

Thus, via the reset tool, the lock assembly can be configured to conform to a profile of a key, without removing the plug assembly from the cylinder body.

As described above, using a manual override or reset tool an operator can reset a lock cylinder by putting it into a learn mode without requiring a valid key. This reset operation could sometimes prove challenging because of the number of actions to perform while holding a compact lock cylinder.

An operator would have to hold the cylinder 210 with one hand and then using the other hand insert the reset tool 310. While maintaining the reset tool 310 in position, the operator would use the bracing bar 360 to push the locking bar 252 inward. To make this reset operation easier, a reset cradle or reset fixture 500 is provided.

FIGS. 44-53 illustrate an exemplary embodiment of a reset fixture 500. The reset fixture includes a housing 510, a reset tool 512, a bracing bar 514 and a retaining pin 516. The housing 510 has central recess 518 extending therethrough configured to receive the lock cylinder 210, a reset opening 520 configured to receive the reset tool 512, a bracing bar opening 522 configured to receive the bracing bar 514, and a pin opening 524 to receive the retaining pin 516.

Figure 49:
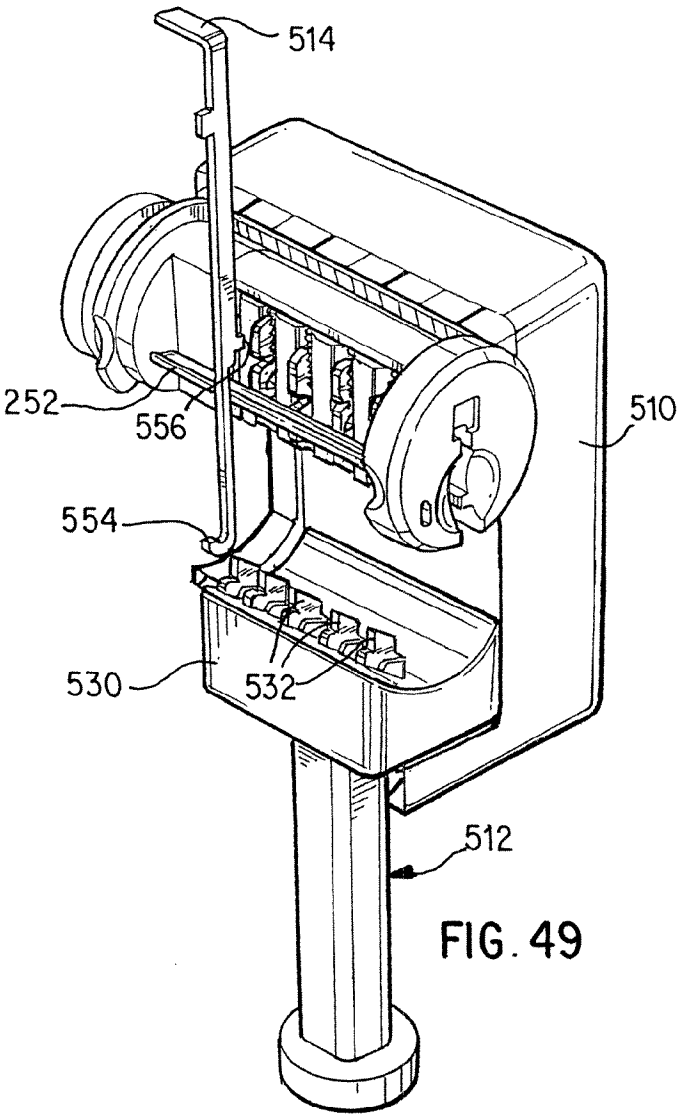
FIG. 49 is a partially broken away view of FIG. 48 illustrating positioning of the racks in a plug body within the lock cylinder.
Figure 48:
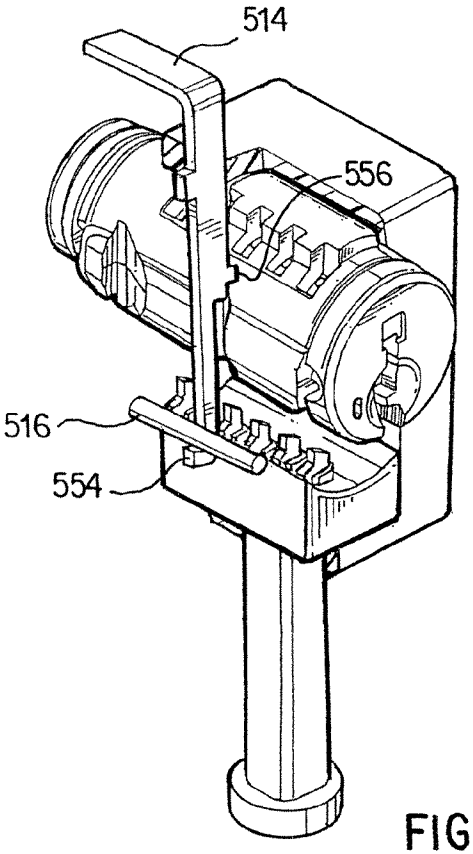
FIG. 48 is a partially broken perspective view of the housing illustrating a bracing bar in a first position and a reset tool in a start position.
Figure 50:
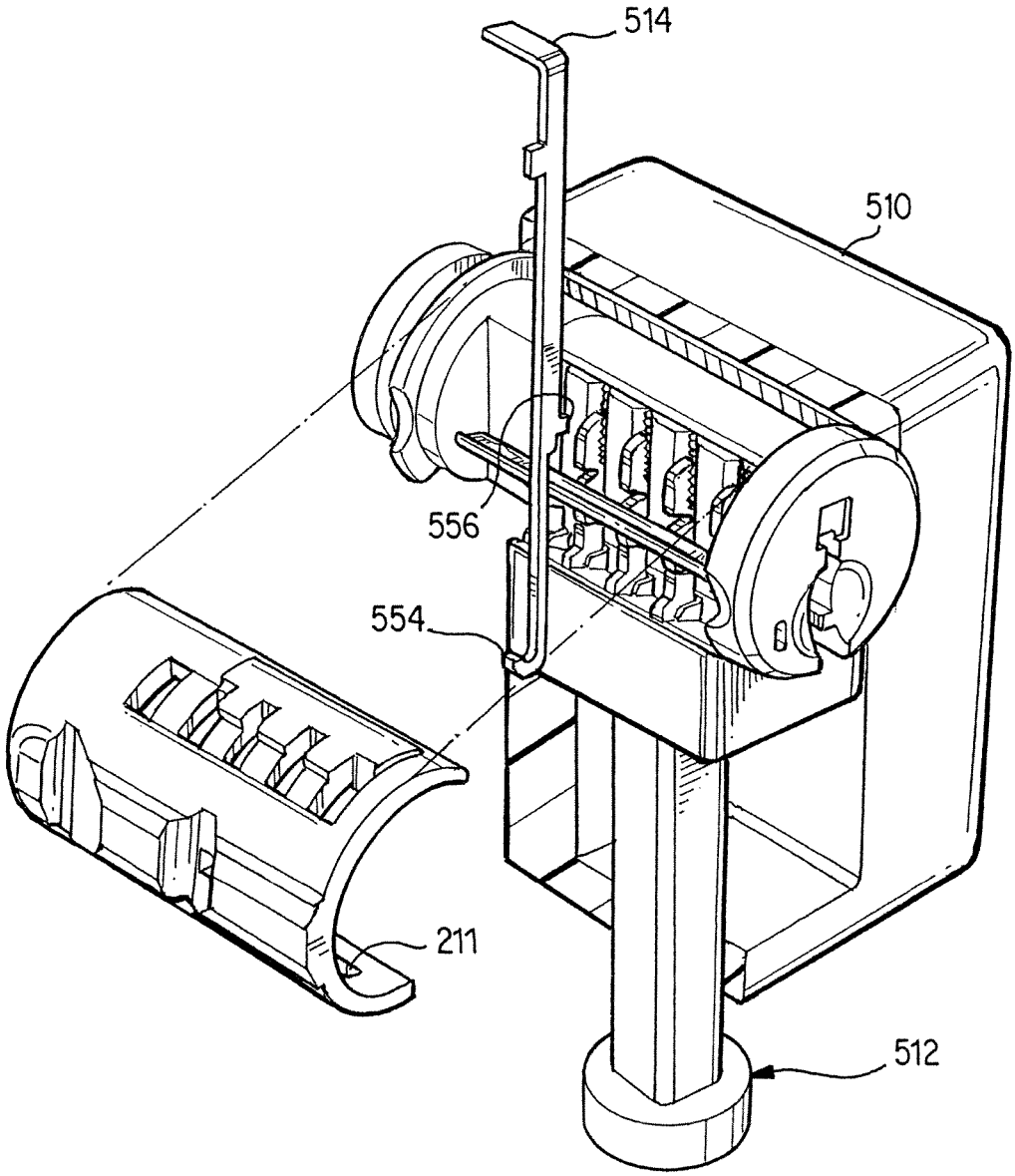
FIG. 50 is a partially broken away perspective view of FIG. 49 illustrating the racks when the reset tool is moved to an engaged position.

The reset tool 512 includes a handle portion 526 and a rack engaging portion 530 having a plurality of prongs 532. The handle portion 526 extends through the reset opening 520, with the rack engaging portion 530 aligned with a lock cylinder disposed in the central recess 518, as illustrated in FIGS. 48-50.

Figure 47A:
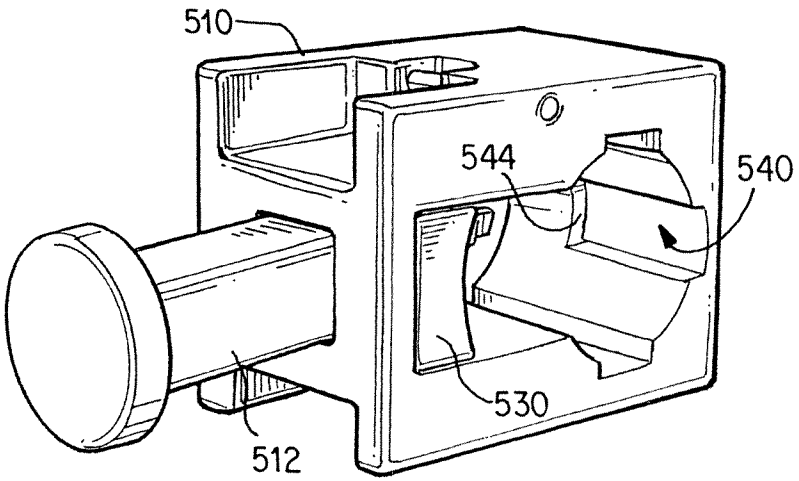
FIG. 47A is a perspective view of the housing taken from a reset face illustrating a reset tool inserted in the housing.
Figure 47:
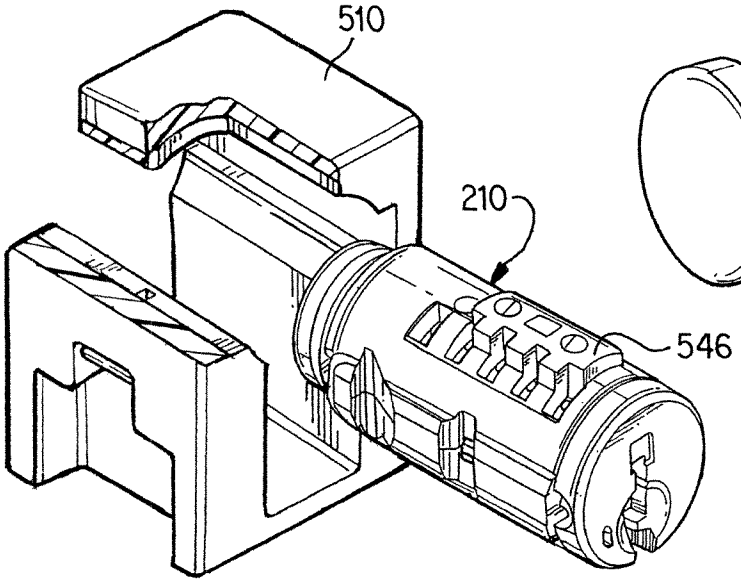
FIG. 47 is an exploded partially broken away perspective view of the housing and a lock cylinder.
Figure 51:
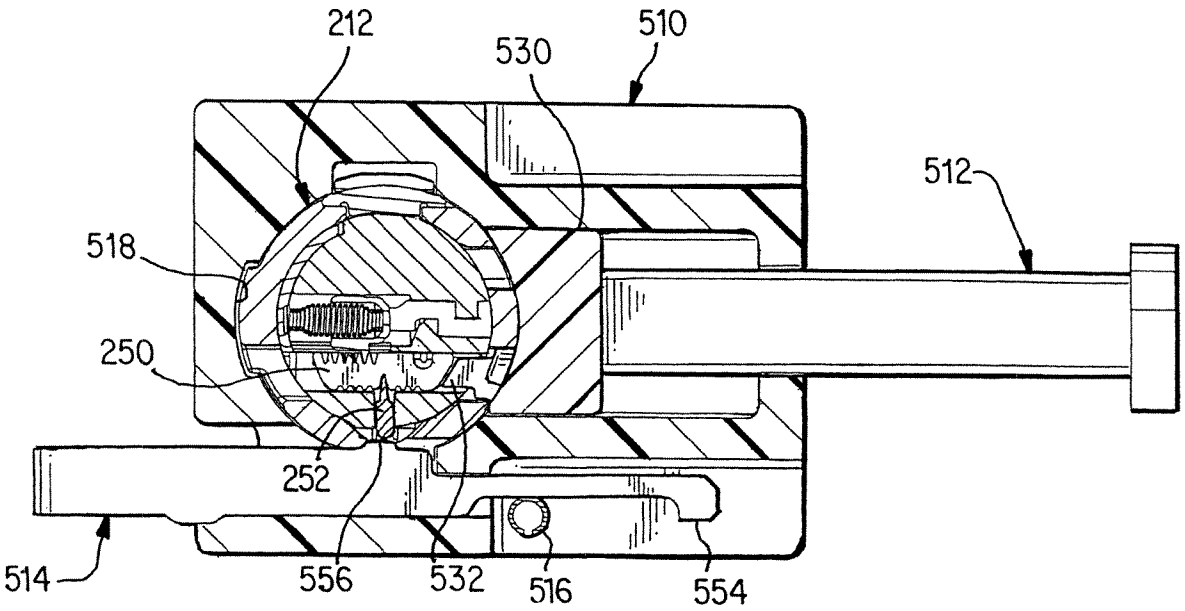
FIG. 51 is a section view of the housing of FIG. 46 with the reset tool in the engaged position and the bracing bar in a locked position.

The central recess 518 includes a channel 540 (FIG. 47A). The channel 540 extends partially through the housing 510, terminating at shoulder 544, and is configured to receive a rectangular projection 546 extending from the lock cylinder body 212 (FIG. 47). The channel 542 and shoulder 544 engage the projection 546 to position the lock cylinder body 212 for engagement with the reset tool 512 and the bracing bar 514. In particular, with the projection 546 disposed in the channel 540, apertures 211 formed in the cylinder body 212 are disposed to receive the prongs 532 of the reset tool 512 and vertical groove 216 is disposed to expose the locking bar 252 to engagement with the bracing bar 514, as illustrated in FIG. 51.

The bracing bar 514 includes an engaging portion 550 and an L-shaped handle portion 552. The engaging portion 550 includes hook 554 for engaging the retaining pin 516 and a finger 556 for engaging the locking bar 252 of lock cylinder 210. The bracing bar 514 extends into the bracing bar opening 522 so that the hook 554 is disposed to engage the retaining pin 516, as illustrated in FIG. 48, and the finger 556 is disposed to engage the locking bar 252, as illustrated in FIG. 51.

Figure 52:
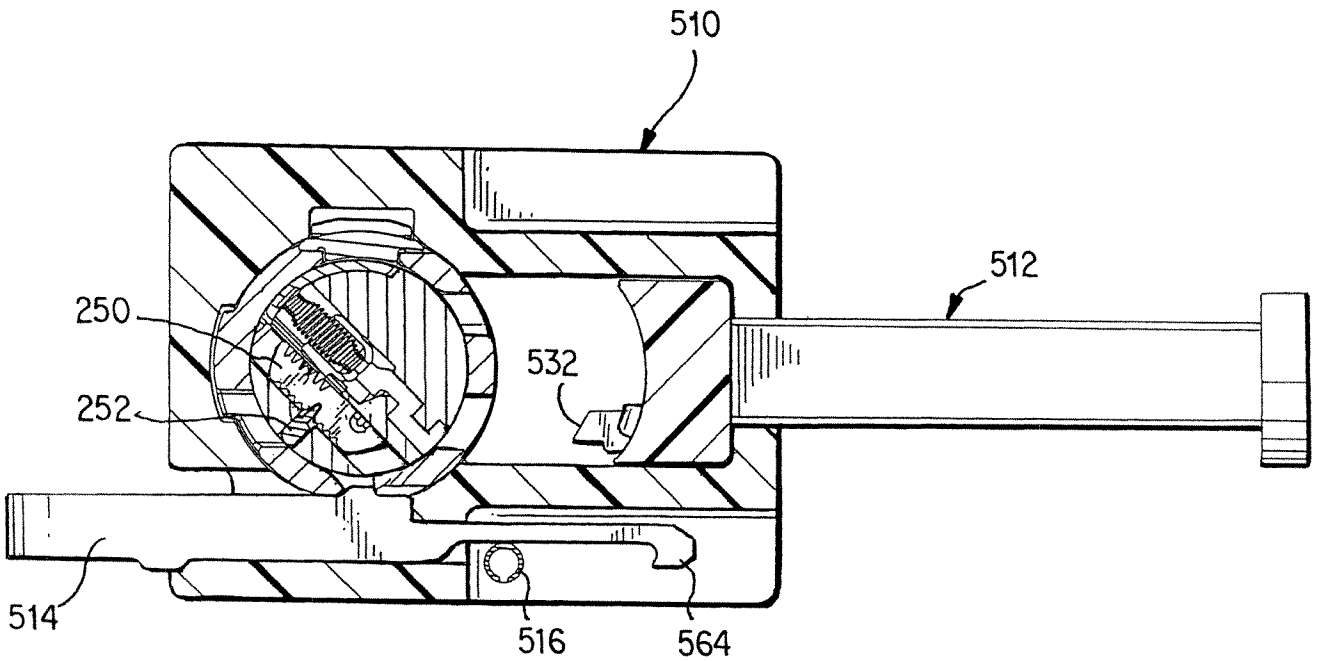
FIG. 52 is the view shown in FIG. 51 with the reset tool moved back to the start position and the plug body in rotation.
Figure 53:
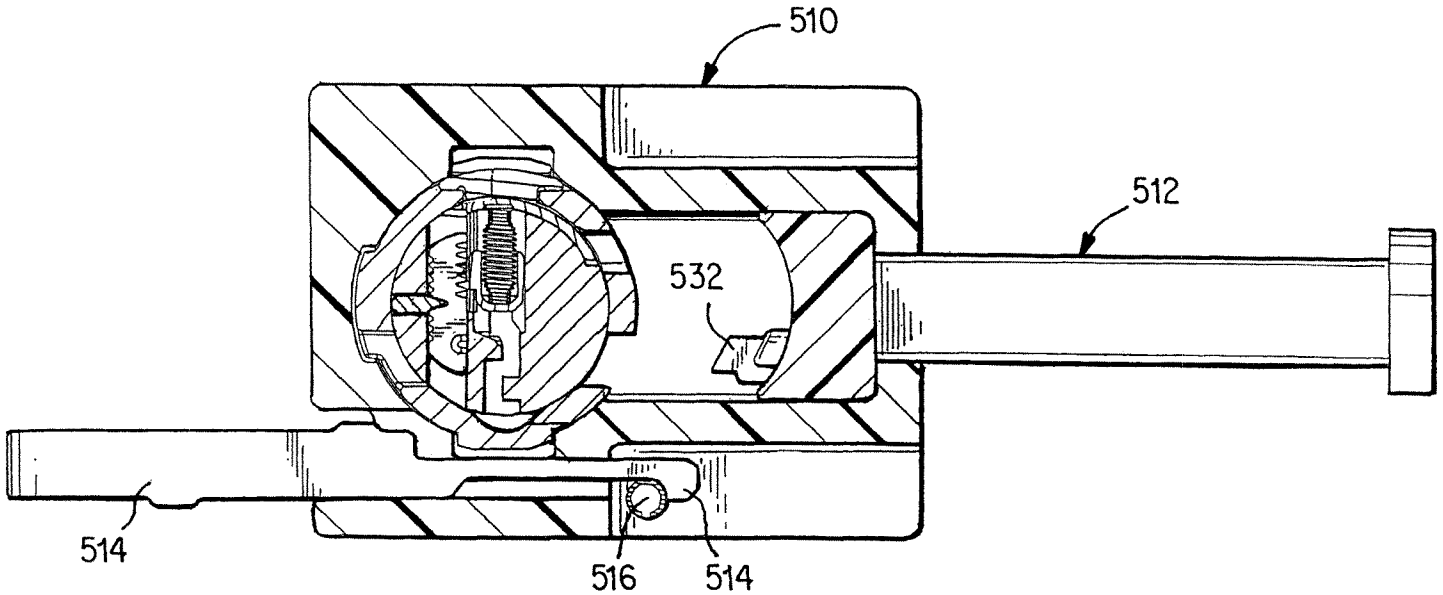
FIG. 53 is the view shown in FIG. 52 with the bracing bar moved back to the first position and the plug body rotated 90 degrees from its position in FIG. 41.
Figure 53A:
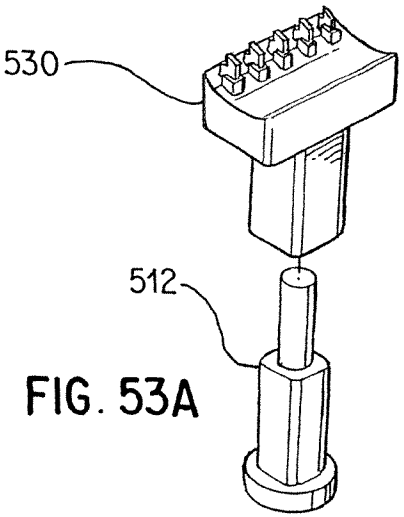
Figure 54:
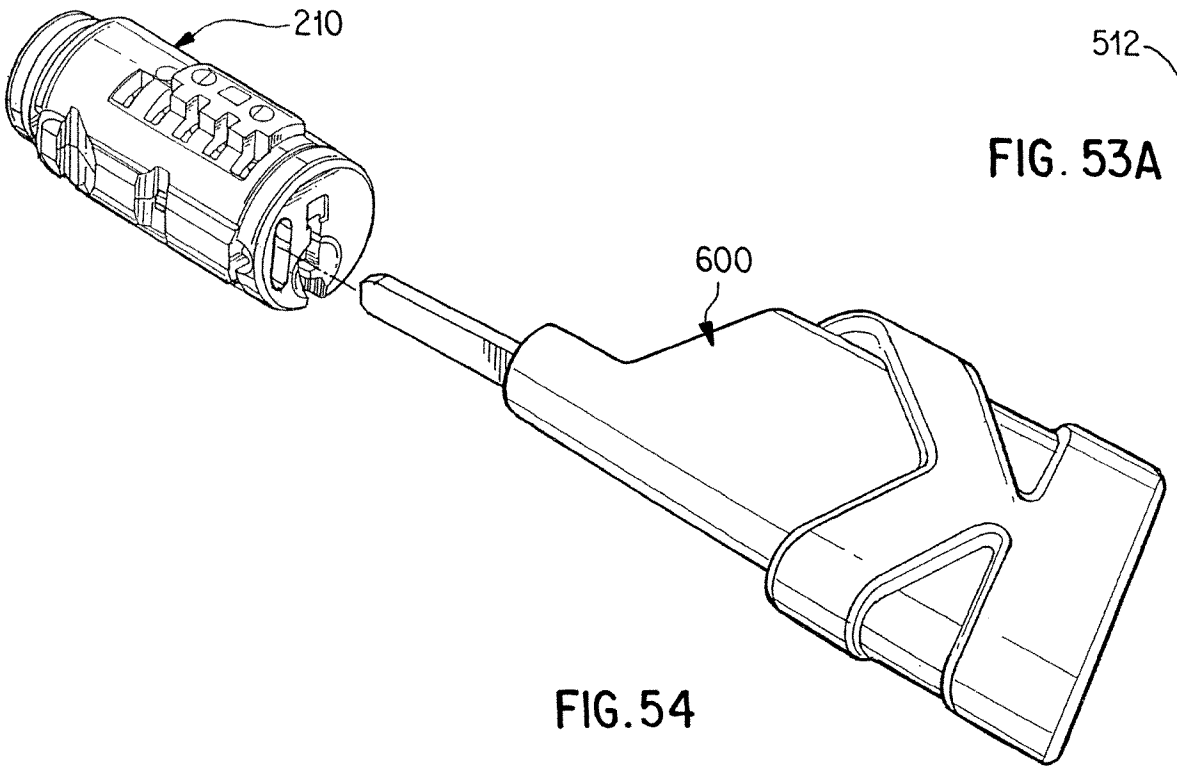
FIG. 54 is a perspective view of a learn tool to be inserted into the lock cylinder.
Figure 55:
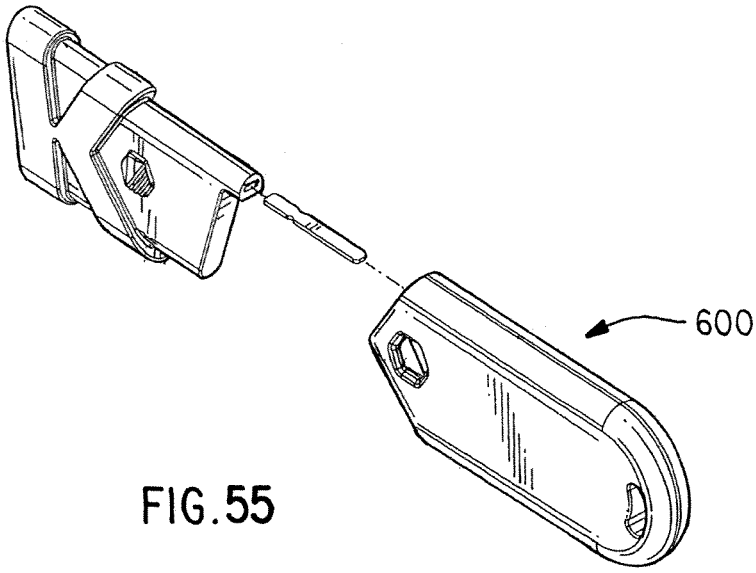
FIG. 55 is an exploded view showing an embodiment of the learn tool.
Figure 56:
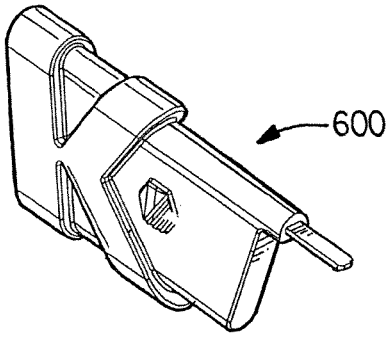
FIG. 56 is a perspective view showing a portion of the learn tool of FIG. 55.
Figure 57:
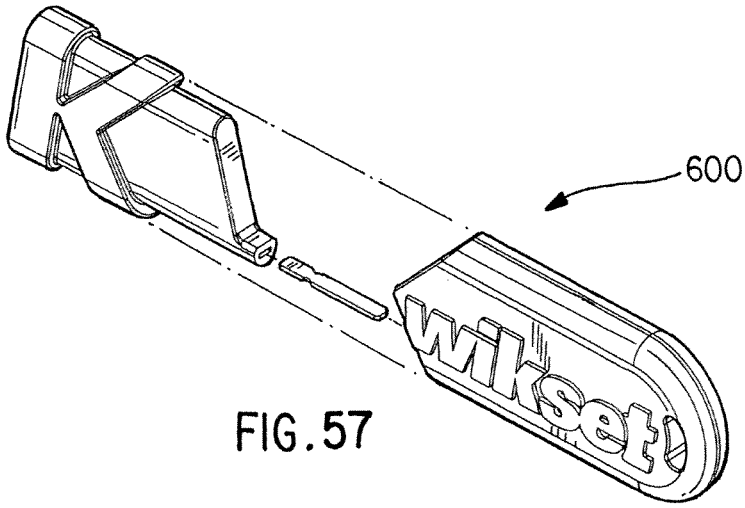
FIG. 57 is another exploded view of the learn tool shown in FIG. 55.
Figure 58:
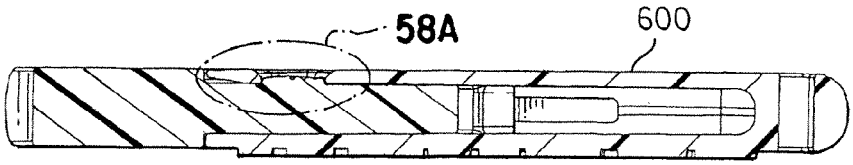
FIG. 58 is a cross-sectional view of the embodiment of learn tool shown in FIG. 59 along line 58-58.
Figure 58A:
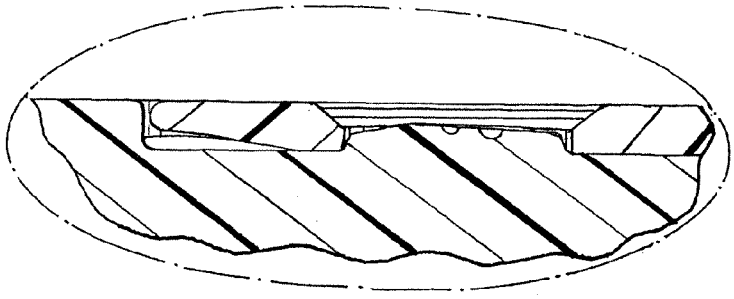
FIG. 58A is an enlarged view of the circled portion of FIG. 58.
Figure 59:
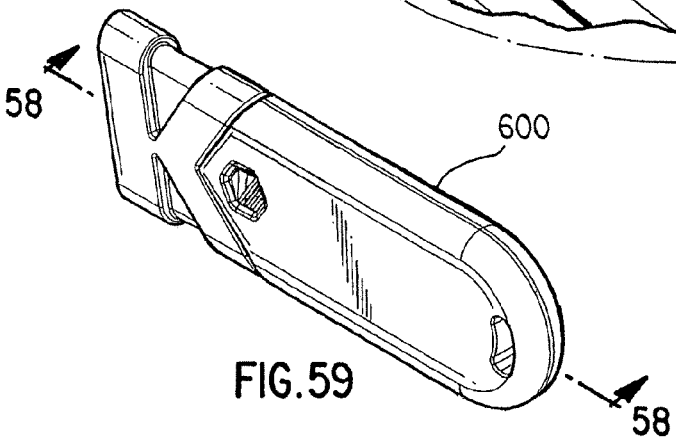
FIG. 59 is another perspective view of an embodiment of the learn tool.
Figure 60:
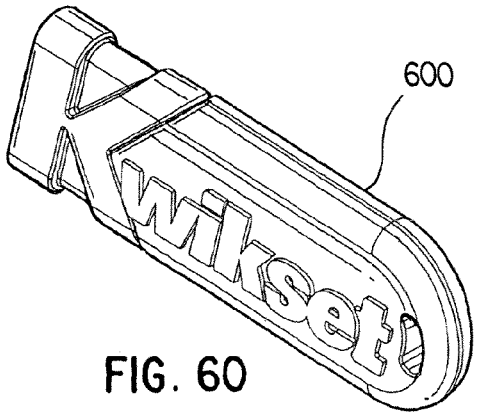
FIG. 60 is a another perspective view of an embodiment of the learn tool.
Figure 61:
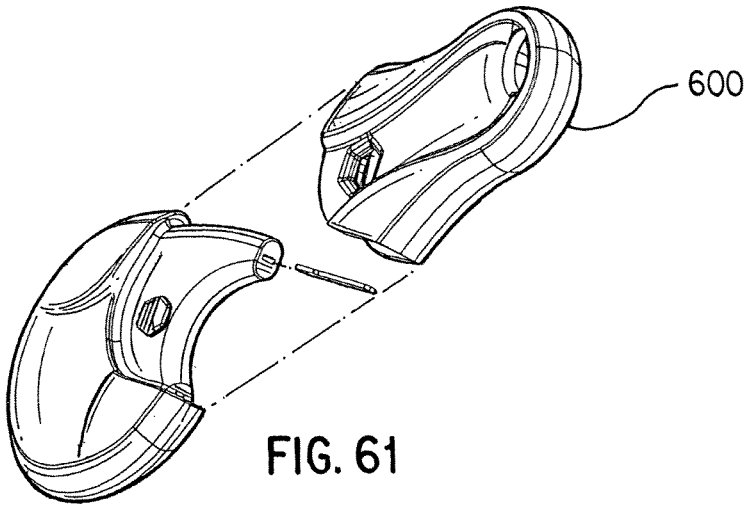
FIG. 61 is an exploded view of another embodiment of the learn tool.
Figure 63:
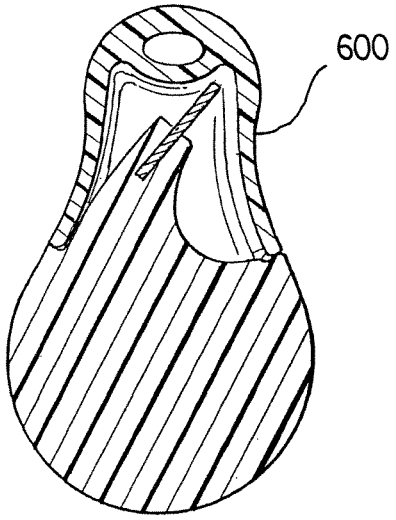
FIG. 63 is a cross-sectional view of the learn tool shown in FIG. 64 along line 63-63.
Figure 62:
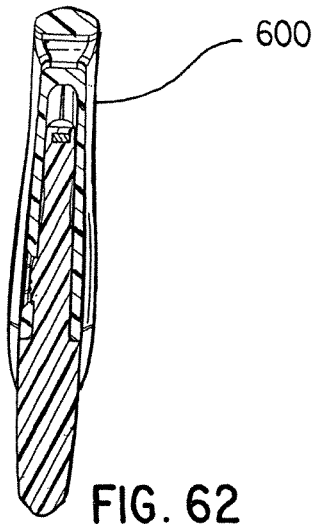
FIG. 62 is a cross-sectional view of the learn tool shown in FIG. 64 along line 62-62.
Figure 64:
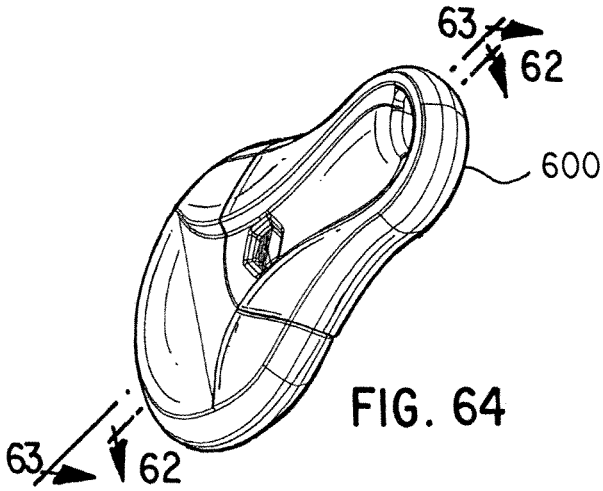
FIG. 64 is a perspective view of the embodiment of the learn tool of FIG. 61.

In operation, the reset fixture 500 is used to hold a blown cylinder assembly—a cylinder assembly that is no longer operable with any valid key—so that it may be reset to the learn mode. A user inserts the lock cylinder 210 into the central recess 518, as illustrated in FIGS. 48 and 49, with the projection 546 aligned with the channel 540. The user then pushes the reset tool 512 into the housing 510 to engage the lock cylinder. As shown in FIG. 50, the reset tool 512 engages the cylinder 210 such that the prongs 532 push the racks 250 into common alignment. As shown in FIG. 51, the user then pushes the bracing bar 514 into the housing 510 such that the finger 556 engages the locking bar 252 and pushes the locking bar 252 into engagement with the racks 250. Once the racks 250 are prevented from moving by the locking bar 252, the user retracts the reset tool 512, as shown in FIG. 52, freeing the plug body 241 to rotate in the cylinder body 212. The user rotates the plug body 241 about 90° and retracts the bracing bar 514, as illustrated in FIG. 53, releasing the lock cylinder 210 from the reset fixture 500. The lock cylinder 210 is now in the rekeying position and can be removed from the reset fixture 500. The user then inserts a learn tool 600 into a hole in the face of the lock cylinder 210, as illustrated in FIG. 54, and pushes the carrier to the learn position, as previously described herein. With the lock cylinder 210 in the learn mode, a valid key is inserted and rotated back to the home position to rekey the lock cylinder 210 to the valid key.

By using the reset fixture 500 the process of rekeying the lock cylinder 210 becomes easier to handle. First the housing 510 holds the cylinder 210 in place thereby freeing up one hand of the operator. Also, the reset fixture 500 provides a guide for the reset tool 512 and the bracing bar 514. This facilitates both the operation of engaging the prongs 532 against the racks 250 and the action of using the bracing bar 514 to move the locking bar 252 into engagement with the racks 250.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scop

The invention claimed is:

1. A method for resetting an inoperative lock cylinder having a cylinder housing, a plug body disposed for rotation in the cylinder housing, and a plurality of racks and a plurality of pins disposed in the plug body, the method comprising the steps of:

providing a reset fixture having a bracing bar and a reset tool, wherein the reset fixture defines a central recess and a channel in the central recess configured to receive a projection extending from the inoperative lock cylinder to orient the inoperative lock cylinder for engagement with the reset tool and the bracing bar, wherein the reset fixture includes a bracing bar opening that extends from the exterior of the reset fixture to the central recess of the reset fixture along a longitudinal axis that is approximately transverse to a longitudinal axis of the central recess and the channel, and wherein the bracing bar opening is located on a side of the reset fixture that is opposite a side of the reset fixture the reset tool opening is located on;

extending the bracing bar through the bracing bar opening of the fixture housing along a longitudinal axis that is approximately transverse to a longitudinal axis of the central recess;

placing the inoperative lock cylinder housing and plug body in the central recess of the reset fixture such that the projection is received in the channel;

moving the plurality of racks to a common alignment using the reset tool while the inoperative lock cylinder housing and plug body are in the central recess of the reset fixture, wherein the reset tool extends through a reset opening defined in the reset fixture;

wherein the reset tool and the bracing bar extend through the fixture housing along a longitudinal axis that is approximately transverse to a longitudinal axis of the recess moving the bracing bar to retain the plurality of racks at the common alignment wherein the bracing bar includes a finger located on its side to engage a locking bar portion of the lock cylinder when extending the bracing bar through the bracing bar opening of the reset fixture; and rotating the plug body in the cylinder housing to a rekeying position.

2. The method of claim 1 further including the steps of removing the lock cylinder from the reset fixture and pushing against an internal lock part disposed in the lock cylinder.

3. The method of claim 2 further including the steps of inserting a key into the lock cylinder and rotating the plug body in the cylinder housing.

4. The method of claim 1 wherein the reset tool includes a plurality of prongs and the step of moving the plurality of racks includes the step of engaging the plurality of racks with the prongs of the reset tool.

5. In combination with an inoperative rekeyable lock cylinder having a cylinder housing and a plug body disposed for rotation in the cylinder housing, a plurality of racks disposed adjacent a plurality of apertures formed in the cylinder housing, and a locking bar disposed adjacent an aperture formed in the cylinder housing, a reset fixture comprising:

a fixture housing having a recess for receiving the cylinder housing and the plug body, wherein the reset fixture defines a channel in the recess configured to receive a projection extending from the inoperative lock cylinder to orient the inoperative lock cylinder for engagement with the reset tool and the bracing bar, wherein the reset fixture includes a bracing bar opening that extends from the exterior of the fixture housing to the central recess of the fixture housing along a longitudinal axis that is approximately transverse to a longitudinal axis of the central recess and the channel, and wherein the bracing bar opening is located on a side of the reset fixture that is opposite a side of the reset fixture the reset tool opening is located on;

a reset tool extending through the fixture housing configured to align the plurality of racks at a common alignment;

wherein the bracing bar extending through the fixture housing configured to retain the plurality of racks at the common alignment wherein the bracing bar includes a finger located on its side to engage a locking bar portion of the lock cylinder when extending the bracing bar through the bracing bar opening of the reset fixture; and wherein the bracing bar extends through the bracing bar opening of the fixture housing along a longitudinal axis that is approximately transverse to a longitudinal axis of the central recess.

6. The reset fixture of claim 5 wherein the reset tool includes a plurality of prongs configured to engage the plurality of racks.

7. The reset fixture of claim 5 wherein the bracing bar is configured to engage a locking bar disposed in the cylinder housing.

* * * * *